US011230882B2

(12) United States Patent
Blair et al.

(10) Patent No.: US 11,230,882 B2
(45) Date of Patent: Jan. 25, 2022

(54) LOW-DEFLECTION ROLLER SHADE TUBE FOR LARGE OPENINGS

(71) Applicant: Lutron Technology Company LLC, Coopersburg, PA (US)

(72) Inventors: Edward J. Blair, Telford, PA (US); David A. Kirby, Zionsville, PA (US); Peter W. Ogden, Jr., Breinigsville, PA (US)

(73) Assignee: Lutron Technology Company LLC, Coopersburg, PA (US)

( * ) Notice: Subject to any disclaimer, the term of this patent is extended or adjusted under 35 U.S.C. 154(b) by 2 days.

(21) Appl. No.: 15/148,926

(22) Filed: May 6, 2016

(65) Prior Publication Data

US 2016/0326801 A1 Nov. 10, 2016

Related U.S. Application Data

(60) Provisional application No. 62/159,132, filed on May 8, 2015.

(51) Int. Cl.

| | |
|---|---|
| ***E06B 9/72*** | (2006.01) |
| ***E06B 9/44*** | (2006.01) |
| ***E06B 9/50*** | (2006.01) |
| *E06B 9/68* | (2006.01) |

(52) U.S. Cl.

CPC ..... *E06B 9/72* (2013.01); *E06B 9/44* (2013.01); *E06B 9/50* (2013.01); *E06B 2009/6845* (2013.01)

(58) Field of Classification Search

CPC ... E06B 9/72; E06B 9/171; E06B 9/44; E06B 2009/6845

See application file for complete search history.

(56) References Cited

U.S. PATENT DOCUMENTS 3,002,534 A * 10/1961 Noland ..... B04B 5/08 138/141
3,299,944 A * 1/1967 Gossling ..... E06B 9/44 160/263

(Continued)

FOREIGN PATENT DOCUMENTS

DE 102011075179 A1 * 11/2011 ..... D21F 3/08
EP 0363887 A2 * 4/1990 ..... B29D 99/0035

(Continued)

*Primary Examiner* — Johnnie A. Shablack

(74) *Attorney, Agent, or Firm* — Condo Roccia Koptiw LLP

(57) ABSTRACT

A low-deflection roller tube of a motorized roller shade may have an outer diameter that does not exceed 2 inches. When a covering material is attached to the roller tube and the roller tube is supported at opposed ends thereof, deflection of a 10 foot configuration of the roller tube may not exceed ⅛ of an inch, and deflection of a 12 foot configuration of the roller tube may not exceed ¼ of an inch, relative to corresponding unloaded positions of the roller tubes. The roller tube may comprise a plurality of layers of carbon fiber, or may comprise an inner tube that is made of a first material, such as aluminum, and a carbon fiber outer tube that is formed on the inner tube. At least one layer, such as an outermost layer, may comprise high modulus carbon fiber.

27 Claims, 11 Drawing Sheets

(56) References Cited

U.S. PATENT DOCUMENTS 3,521,694 A * 7/1970 Anderson ..... E06B 9/44 160/323.1
3,810,803 A * 5/1974 Karp ..... B31C 3/00 156/190
3,854,517 A * 12/1974 Nakamura ..... E06B 9/50 160/321
3,896,858 A * 7/1975 Whatley ..... B29C 53/585 138/130
3,900,063 A * 8/1975 Roller ..... E06B 9/17 160/310
4,006,770 A * 2/1977 Ferguson ..... E06B 9/17 160/263
4,234,190 A 11/1980 Airhart et al.
4,427,050 A * 1/1984 Toppen ..... E06B 9/60 160/315
4,429,729 A * 2/1984 Winslow ..... E06B 9/60 144/193.1
4,523,620 A * 6/1985 Mortellite ..... E06B 9/60 160/315
4,633,927 A * 1/1987 Labelle ..... E06B 9/171 160/133
4,636,106 A * 1/1987 Waisbrod ..... F16B 7/10 403/221
4,971,846 A * 11/1990 Lundy ..... B29C 53/845 138/145
5,061,533 A * 10/1991 Gomi ..... B65H 27/00 428/36.3
5,221,391 A * 6/1993 Kittaka ..... B29C 53/566 156/171
5,468,568 A * 11/1995 Kuhn ..... B41N 1/20 101/217
5,487,806 A * 1/1996 Viellard ..... B29C 33/505 156/156
5,549,947 A * 8/1996 Quigley ..... B29C 70/222 428/36.2
5,556,673 A * 9/1996 Giraud ..... E04C 3/29 428/34.4
5,575,875 A * 11/1996 Brittingham ..... A63B 49/10 156/169
5,900,194 A * 5/1999 Ashton ..... B29C 33/44 264/257
6,106,413 A * 8/2000 Kusumoto ..... A63B 60/54 473/319
6,201,364 B1 3/2001 Will et al.
6,315,704 B1 * 11/2001 Sohl ..... D21G 1/0233 492/53
6,397,545 B1 * 6/2002 Fanucci ..... E04C 3/29 52/301
6,434,906 B1 * 8/2002 Jernstrom ..... E04H 12/02 52/848
6,513,431 B2 * 2/2003 Huber ..... B41N 6/00 101/375
6,534,140 B2 * 3/2003 Hargett, Jr. ..... B01J 3/048 422/241
6,845,806 B2 1/2005 Gottschall et al.
6,902,141 B2 * 6/2005 Kirby ..... E06B 9/42 160/323.1
6,955,024 B2 * 10/2005 Ashton ..... B29C 53/60 156/180
6,983,783 B2 1/2006 Carmen, Jr. et al.
7,051,782 B2 5/2006 Nichols, Jr. et al.
7,163,044 B2 * 1/2007 Kirby ..... E06B 9/42 160/262
7,232,649 B2 * 6/2007 Vest ..... G03F 7/11 430/270.1
7,284,356 B2 * 10/2007 Copeland ..... B29C 53/587 52/834
7,823,620 B2 11/2010 Kirby et al.
7,839,109 B2 11/2010 Carmen, Jr. et al.
7,861,653 B2 * 1/2011 Dylla ..... B41F 31/26 101/368
8,006,737 B2 * 8/2011 Popa ..... E04F 10/06 160/263
8,016,016 B2 * 9/2011 Berman ..... E06B 9/17007 160/242
8,579,739 B2 11/2013 Song et al.
8,651,166 B1 * 2/2014 Daniels ..... E06B 9/44 160/238
8,899,300 B2 * 12/2014 Daniels ..... E06B 9/44 160/238
8,950,461 B2 2/2015 Adams et al.
9,045,939 B2 6/2015 Blair et al.
9,057,204 B2 * 6/2015 Friedrich ..... B29C 53/60
9,133,663 B2 * 9/2015 Klish ..... E06B 9/82
9,194,671 B1 11/2015 Song
9,249,621 B2 * 2/2016 Dwarka ..... E06B 9/17007
9,366,080 B2 * 6/2016 Colson ..... E06B 9/34
9,376,863 B2 * 6/2016 Mullet ..... E06B 9/40
9,428,955 B2 * 8/2016 Fleischman ..... E06B 9/58
9,458,663 B2 * 10/2016 Colson ..... B29C 65/4815
9,488,000 B2 11/2016 Kirby et al.
9,523,236 B2 * 12/2016 Bergamaschi ..... E06B 9/42
10,272,302 B2 * 4/2019 Mordasini ..... B29C 53/60
11,000,743 B2 * 5/2021 Nakamura ..... A63B 60/42
2002/0079068 A1 * 6/2002 Kessous ..... E06B 9/40 160/290.1
2003/0157285 A1 * 8/2003 Busshoff ..... B29C 63/20 428/36.4
2005/0077017 A1 * 4/2005 Ramsey ..... E06B 9/42 160/238
2005/0082452 A1 * 4/2005 Kirby ..... E06B 9/50 248/266
2005/0155697 A1 * 7/2005 Lin ..... A63B 53/10 156/187
2006/0118252 A1 * 6/2006 Kirby ..... E06B 9/42 160/262
2006/0232233 A1 * 10/2006 Adams ..... E06B 9/72 318/280
2008/0230192 A1 * 9/2008 Kane ..... E06B 9/40 160/311
2009/0098324 A1 * 4/2009 Hasegawa ..... B29C 70/446 428/36.4
2010/0219306 A1 * 9/2010 Detmer ..... E06B 9/72 248/201
2010/0294440 A1 * 11/2010 Li ..... E06B 9/42 160/310
2010/0307701 A1 * 12/2010 Peterson ..... E06B 9/72 160/310
2011/0192528 A1 * 8/2011 Kozaki ..... B29C 53/585 156/173
2011/0290432 A1 * 12/2011 Berman ..... E06B 9/17007 160/242
2013/0213585 A1 * 8/2013 Nenonen ..... E06B 9/42 160/23.1
2014/0216666 A1 * 8/2014 Smith ..... E06B 9/38 160/84.04
2014/0262084 A1 * 9/2014 Fleischman ..... E06B 9/58 160/368.1
2014/0346811 A1 * 11/2014 Zaluzec ..... B29C 70/30 296/187.12
2015/0000849 A1 * 1/2015 Barnes ..... E06B 9/42 160/310
2015/0275575 A1 * 10/2015 Haarer ..... E06B 9/42 160/315
2015/0361717 A1 * 12/2015 Zelfde ..... E06B 9/40 160/309
2016/0032646 A1 * 2/2016 Fleischman ..... E06B 9/40 160/309
2016/0130866 A1 * 5/2016 Buccola, Jr. ..... E06B 9/322 185/9
2016/0145938 A1 * 5/2016 Colson ..... E06B 9/42 160/133
2016/0208550 A1 * 7/2016 Barnes ..... E06B 9/44
2016/0237743 A1 * 8/2016 Holt ..... E06B 9/262

(56) References Cited

U.S. PATENT DOCUMENTS

| | | | | |
|---|---|---|---|---|
| 2016/0369556 | A1* | 12/2016 | Fleishman | E06B 9/58 |
| 2019/0290978 | A1* | 9/2019 | Mordasini | A63B 60/54 |

FOREIGN PATENT DOCUMENTS

| | | | | |
|---|---|---|---|---|
| EP | 1662236 | A2 * | 5/2006 | G01F 1/8404 |
| EP | 2208849 | A1 | 7/2010 | |
| FR | 2872196 | A1 | 12/2005 | |
| WO | WO 2006/006057 | A1 | 1/2006 | |

* cited by examiner

L

LOW-DEFLECTION ROLLER SHADE TUBE FOR LARGE OPENINGS

CROSS-REFERENCE TO RELATED APPLICATIONS

This application claims priority to U.S. provisional patent application No. 62/159,132, filed May 8, 2015, which is incorporated herein by reference in its entirety.

BACKGROUND

A window treatment may be mounted in front of one or more windows, for example to prevent sunlight from entering a space and/or to provide privacy. Window treatments may include, for example, roller shades, roman shades, venetian blinds, or draperies. A roller shade typically includes a flexible shade fabric wound onto an elongated roller tube. Such a roller shade may include a weighted hembar located at a lower end of the shade fabric. The hembar may cause the shade fabric to hang in front of one or more windows that the roller shade is mounted in front of.

Advances in window construction technology have enabled the manufacture of windows in ever increasing sizes, such as windows that may be 8 or more feet wide. Such large windows may require similarly large window treatments. For example, a roller shade configured to cover such a wide window may require an unusually long roller tube.

It may be desirable, in manufacturing a roller shade for a wide window, to maintain the aesthetics of a related roller shade that is sized for a smaller window. However, the roller tube of a roller shade that is simply supported at opposed ends of the tube may exhibit increasing deflection from the ends of the tube to the middle of the tube. This phenomenon may be referred to as tube sag. Tube sag may present a limitation to how long the roller tube of a roller shade may be made. And tube sag may become more pronounced as roller tube length increases.

An excess of tube sag may cause a roller shade to exhibit undesirable aesthetic and/or operational characteristics. For example, tube sage may cause visible sag lines to appear in the shade material. Additionally, tube sag may cause the shade material of a roller shade to wrinkle as the shade rolls up. In a roller shade with little to no tube sag, the shade material typically rolls up perpendicular to the roller tube. However, when a roller tube exhibits tube sag, the right half of the shade material may travel leftward and/or the left half of the shade material may travel rightward as the shade rolls up. This may introduce wrinkles into the rolled up shade material.

Known solutions for addressing tube sag in a roller shade may have one or more undesirable characteristics. For example, a first solution may be to increase the tube diameter of a roller tube to achieve an increased stiffness. However, such an enlarged roller tube may require additional space, which may negatively impact the aesthetic of an installation of the roller shade. In another solution, the shade material may be supported at one or more locations along the length of the roller tube. However, movement of the shade material over the supports may cause undesirable wear to the shade material.

SUMMARY

As described herein, the roller tube of a motorized roller shade may be configured as a low deflection roller tube for use in covering a large opening, such as an opening that is 8 feet wide or wider. The roller tube may define opposed first and second ends, and may be configured to be supported at the first and second ends.

The roller shade may include a covering material that is attached to the roller tube. The covering material may be operable between a raised position and a lowered position via rotation of the roller tube by the motor drive unit. The roller shade may include a hembar that is attached to a lower end of the covering material.

In accordance with an example motorized roller shade, the roller tube of the roller shade may be configured for use in covering an opening that is 10 feet wide. The roller tube may have a length of 10 feet along a longitudinal direction. The roller tube may have an outer diameter that does not exceed 2 inches. The roller tube may be configured such that when the covering material is in a lowered position and the roller tube is supported at the first and second ends, deflection of the roller tube does not exceed ⅛ of an inch relative to the unloaded position of the roller tube.

In accordance with another example motorized roller shade, the roller tube of the roller shade may be configured for use in covering an opening that is 12 feet wide. The roller tube may have a length of 12 feet along a longitudinal direction. The roller tube may have an outer diameter that does not exceed 2 inches. The roller tube may be configured such that when the covering material is in a lowered position and the roller tube is supported at the first and second ends, deflection of the roller tube does not exceed ¼ of an inch relative to an unloaded position of the roller tube.

The example low-deflection roller tubes may define respective pluralities of splines that extend from the inner surface. The plurality of splines may be configured to operatively engage with complementary grooves defined by a drive hub of the motor drive unit. The splines of each roller tube may extend parallel to an axis of rotation of the roller tube, and may be spaced apart from each other equally or unequally along a circumference of the inner surface. Each of the plurality of the splines may extend from the first end to the second end of the roller tube.

The example low-deflection roller tubes may be manufactured of carbon fiber. For example, a low-deflection roller tube may comprise a plurality of layers of carbon fiber. At least one layer of the plurality of layers may comprise high modulus carbon fiber. For example, an outermost layer of the plurality of layers may comprise high modulus carbon fiber.

In addition, the example low-deflection roller tubes may be two-part roller tubes that each include a first tube and a second tube. The first tube may be an inner tube that is made of a first material such as aluminum, steel, or the like. The first tube may be configured to operatively engage with complementary grooves defined by the drive hub of the motor drive unit. For example, the first tube may define a plurality of splines that extend from an inner surface of the first tube, may include one or more engagement members that extend from the inner surface, or may otherwise be configured to operatively engage with the motor drive unit. The second tube may made of carbon fiber material, and may be an outer tube that is attached to an outer surface of the inner tube. The second tube may be additively constructed on the first tube, for example by filament winding carbon fiber material onto the first tube.

An example process of manufacturing a low-deflection carbon fiber roller tube may include applying a first layer of carbon fiber fabric to a cylindrical mandrel. The mandrel may be elongate along a central axis, and may be tapered between opposed first and second ends thereof. An outer surface of the mandrel may define a plurality of grooves that extend parallel to the central axis.

The first layer of carbon fiber fabric may be oriented such that fibers thereof are parallel to the central axis. The first layer of carbon fiber fabric may be applied to the mandrel such that respective portions of the first layer of carbon fiber fabric are disposed into corresponding grooves of the mandrel. The example process may include applying a second layer of carbon fiber fabric to the first layer of carbon fiber fabric. The second layer of carbon fiber fabric may be oriented such that fibers thereof are angularly offset relative to the central axis, for example by 7°.

The example process may include applying a third layer of carbon fiber fabric to the second layer of carbon fiber fabric. The third layer of carbon fiber fabric may be oriented such that fibers thereof are angularly offset by forty five degrees relative to the central axis.

The example process may include applying a fourth layer of carbon fiber fabric to the third layer of carbon fiber fabric. The fourth layer of carbon fiber fabric may be oriented such that fibers thereof are angularly offset by ninety degrees relative to the central axis.

The example process may include applying a fifth layer of carbon fiber fabric to the fourth layer of carbon fiber fabric. The fifth layer of carbon fiber fabric may be oriented such that fibers thereof are angularly offset by forty five degrees relative to the central axis.

The example process may include applying a sixth layer of carbon fiber fabric to the fifth layer of carbon fiber fabric. The sixth layer of carbon fiber fabric may be oriented such that fibers thereof are angularly offset by seven degrees relative to the central axis.

The example process may include curing the first, second, third, fourth, fifth, and sixth layers of carbon fiber fabric. At least one of the first, second, third, fourth, fifth, and sixth layers of carbon fiber fabric may comprise high modulus carbon fiber. For example, the sixth layer of carbon fiber fabric may comprise high modulus carbon fiber.

DETAILED DESCRIPTION

Figure 1A:
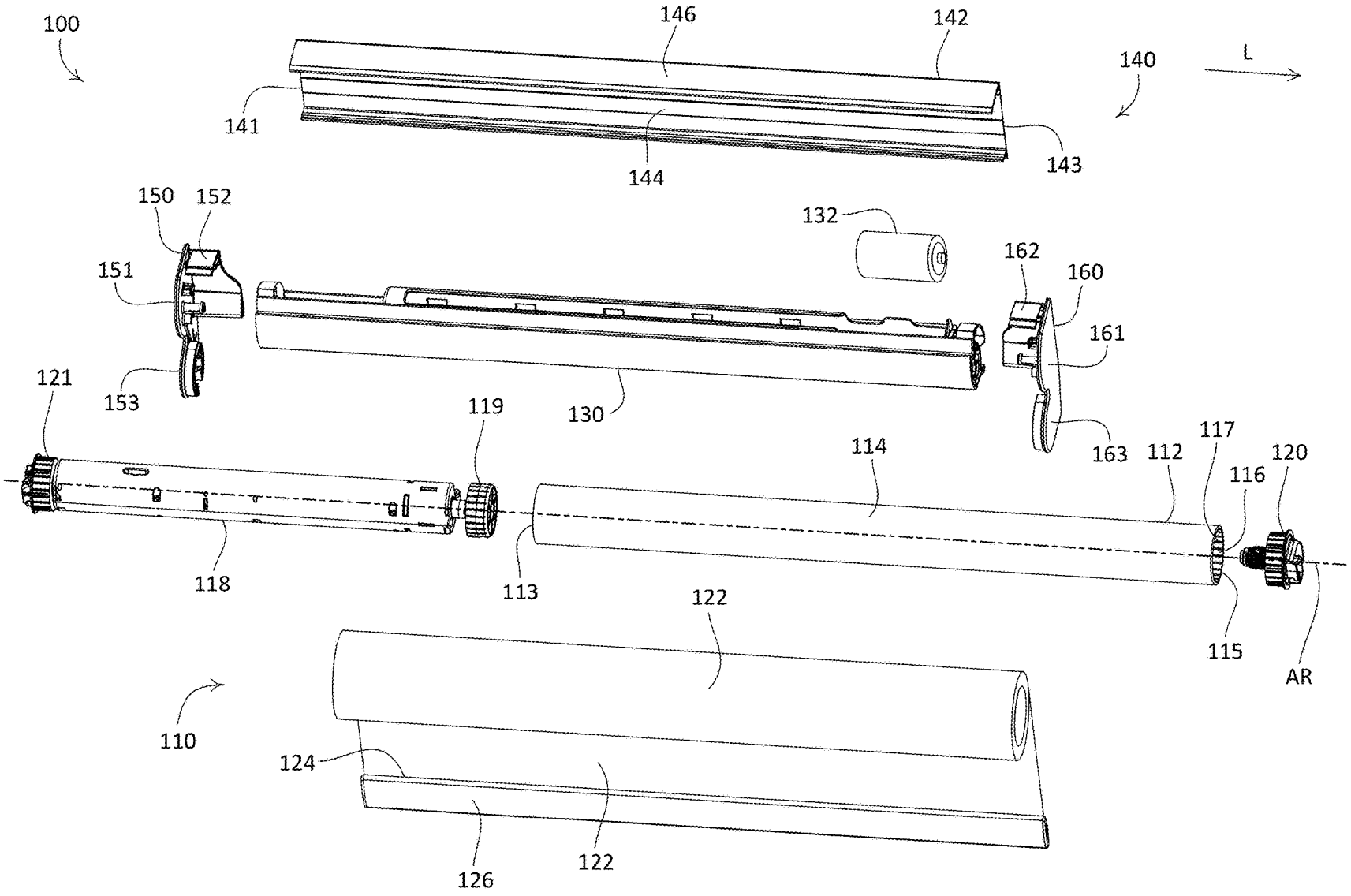
FIG. 1A is an exploded view of an example battery-powered roller shade for use in an oversized opening, the battery-powered roller shade including an example low-deflection roller tube.
Figure 1B:
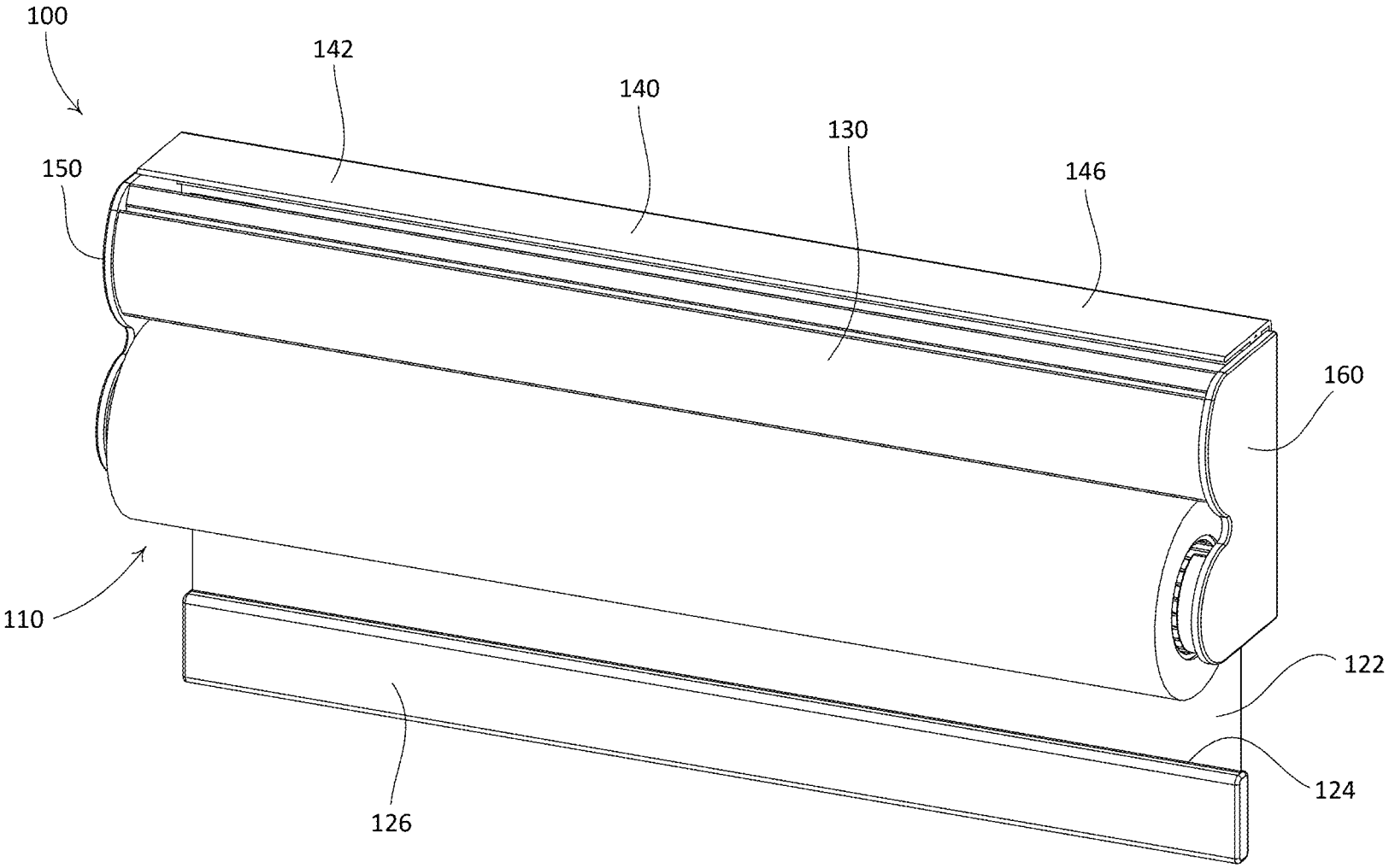
FIG. 1B is a perspective view of the example battery-powered roller shade depicted in FIG. 1A, with the shade in a raised position.
Figure 1C:
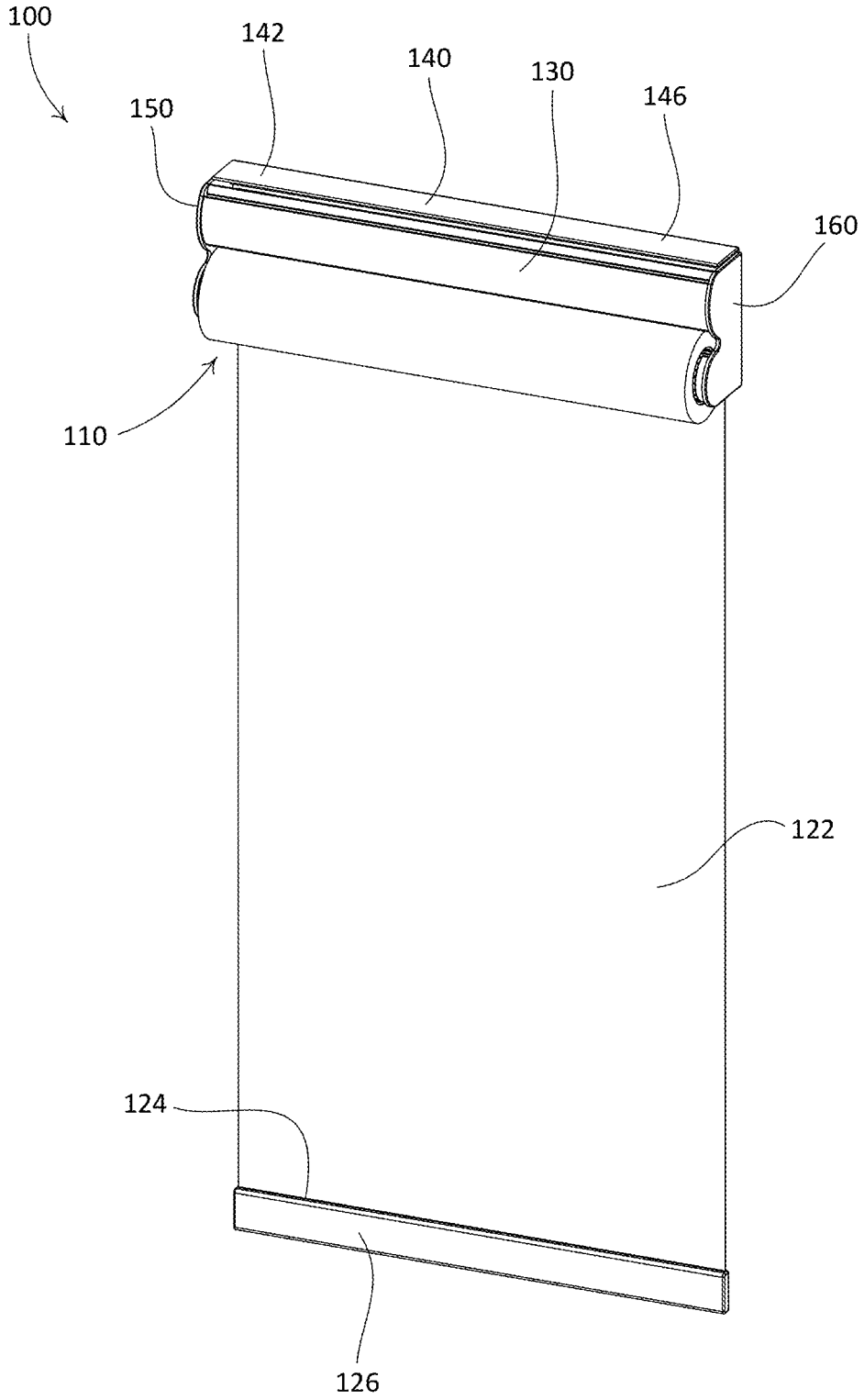
FIG. 1C is a perspective view of the example battery-powered roller shade depicted in FIG. 1A, with the shade in a lowered position.

FIGS. 1A-1C depict an example window treatment, in the form of a motorized roller shade 100, that may be mounted in front of a large opening, such as one or more windows that span 8 feet or more in width, to prevent sunlight from entering a space and/or to provide privacy. The motorized roller shade 100 may be mounted to a structure that is proximate to the opening, such as a window frame, a wall, or other structure. As shown, the motorized roller shade 100 includes a shade assembly 110, a battery compartment 130, and a housing 140 that may be configured to support the shade assembly 110 and the battery compartment 130. The housing 140 may be configured as a mounting structure and/or a support structure for one or more components of the motorized roller shade 100.

As shown, the housing 140 includes a rail 142, a first housing bracket 150, and a second housing bracket 160. The illustrated rail 142 is elongate between a first end 141 and an opposed second end 143. The rail 142, the first housing bracket 150, and the second housing bracket 160 may be configured to attach to one another in an assembled configuration. For example, the first housing bracket 150 may be configured to be attached to the first end 141 of the rail 142, and the second housing bracket 160 may be configured to be attached to the second end 143 of the rail 142. As shown, the first housing bracket 150 defines an attachment member 152 that is configured to engage the first end 141 of the rail 142, and the second housing bracket 160 defines an attachment member 162 that is configured to engage the second end 143 of the rail 142. It should be appreciated that the rail 142, the first housing bracket 150, and the second housing bracket 160 are not limited to the illustrated attachment members.

One or more of the rail 142, the first housing bracket 150, or the second housing bracket 160, may be sized for mounting to a structure. For example, the rail 142 may be sized such that, with the first and second housing brackets 150, 160 attached to the rail 142, the rail 142 may be mounted to a structure in an opening (e.g., to a window frame). In such an example configuration, the rail 142 may define a length, for example as defined by the first and second ends 141, 143, such that the housing 140 may fit snugly in a window frame (e.g., with little clearance between the first and second housing brackets 150, 160 and adjacent structure of a window frame). This configuration may be referred to as an internal mount configuration. In another example, the rail 142 may be sized such that, with the first and second housing brackets 150, 160 attached to the rail 142, the rail 142 may be mounted to a structure above an opening (e.g., to a surface above a window). In such an example configuration, the rail 142 may define a length that is substantially equal to (e.g., slightly longer than) a width of the window opening. In still another example, one or more of the rail 142, the first housing bracket 150, or the second housing bracket 160 may be sized such that the motorized roller shade 100 may be mounted within a cavity defined by a window treatment pocket that may be mounted to a structure, such as structure surrounding a window. It should be appreciated, however, that the motorized roller shade 100 is not limited to these example mounting configurations.

The rail 142 may define any suitable shape. As shown, the rail 142 includes a rear wall 144 and an upper wall 146 that extends outward from an upper edge of the rear wall 144 along a direction that is substantially perpendicular to the rear wall 144. One or both of the rear wall 144 and the upper wall 146 may be configured to be mounted to a structure. The rail 142, the first housing bracket 150, and the second housing bracket 160, when in an assembled configuration, may define a cavity. The shade assembly 110 and the battery compartment 130 may be disposed in the cavity, for example when the motorized roller shade 100 is in an assembled configuration (e.g., as shown in FIGS. 1B and 1C). When the motorized roller shade 100 is in an assembled configuration, the housing 140 may be open at the front and bottom, such that the shade assembly 110 and the battery compartment 130 are exposed. The motorized roller shade 100 may optionally include a fascia (not shown) that is configured to conceal one or more components of the motorized roller shade 100, such as the battery compartment 130 and portions of the shade assembly 110.

As shown, the shade assembly 110 includes a roller tube 112, a motor drive unit 118, an idler 120, a covering material 122 (e.g., a shade fabric), and a hembar 126. The roller tube 112 may have a tube body 114 that is elongate along a longitudinal direction L from a first end 113 to an opposed second end 115. The tube body 114 may define any shape, such as the illustrated cylindrical shape. As shown, the roller tube 112 is hollow, and open at the first and second ends 113, 115. The roller tube 112 may be configured to at least partially receive the motor drive unit 118, and to at least partially receive the idler 120. As shown, the roller tube 112 is configured such that a portion of the motor drive unit 118 may be disposed in the first end 113, and such that a portion of the idler 120 may be disposed in the second end 115.

The tube body 114 may define an inner surface 116 that is configured to operatively engage with the motor drive unit 118. For example, as shown, the tube body 114 defines a plurality of splines 117 that extend radially inward from the inner surface 116. The roller tube 112 may be configured to operatively engage with the motor drive unit 118 via the plurality of splines 117. For example, the splines 117 may be configured to operatively engage with a component of the motor drive unit 118, such that rotational torque may be transferred to the roller tube 112 from the motor drive unit 118, thereby causing the roller tube 112 to rotate about an axis of rotation AR. The axis of rotation AR of the roller tube 112 may also be referred to as a central axis of the roller tube 112.

The splines 117 may extend parallel to the longitudinal direction L, and may be spaced apart from each other equally, as shown, or unequally along a circumference of the inner surface 116 of the roller tube 112. Each of the illustrated splines 117 extends from the first end 113 to the second end 115 of the tube body 114. It should be appreciated that the roller tube 112 is not limited to illustrated configuration and/or geometry of splines 117. It should further be appreciated that the roller tube 112 may be alternatively configured to operably engage with the motor drive unit 118. For example, in accordance with an alternative configuration of the roller tube 112, the tube body 114 may define a smooth inner surface 116, and may define an opening that extends through the tube body 114 at a location such that the roller tube 112 may be operatively coupled to the motor drive unit 118 via one or more fasteners that may be disposed into the opening and that may engage the motor drive unit 118 (e.g., such as screws, pins, clips, or the like).

The illustrated motor drive unit 118 may be configured to be disposed into the first end 113 of the roller tube 112. One or more components of the motor drive unit 118 may be configured to engage with the plurality of splines 117 of the roller tube 112. As shown, the motor drive unit includes a drive hub 119 that defines a plurality of grooves that are configured to operably engage with corresponding ones of the splines 117, such that operation of the motor drive unit 118 may cause the roller tube 112 to rotate. The motor drive unit 118 may further include an integrated idler 121 that defines a plurality of grooves that are configured to engage with corresponding ones of the splines 117. The idler 120 may similarly define a plurality of grooves that are configured to engage with corresponding ones of the splines 117. The grooves of the drive hub 119 and the idler 120 may be spaced apart from each other equally, as shown, or unequally along the circumferences of respective outer surfaces of the drive hub 119 and the idler 120.

The covering material 122 may define an upper end (not shown) that is configured to be operably attached to the roller tube 112, and an opposed lower end 124 that is configured as a free end. Rotation of the roller tube 112 about the axis of rotation AR, for example rotation caused by the motor drive unit 118, may cause the covering material 122 to wind onto, or to unwind from, the roller tube 112. In this regard, the motor drive unit 118 may adjust the covering material 122, for instance between raised and lowered positions of the covering material 122 as shown in FIGS. 1B and 1C, respectively.

Rotation of the roller tube 112 in a first direction about the axis of rotation AR may cause the covering material 122 to unwind from the roller tube 112, for example as the covering material 122 is operated to a lowered position relative to an opening (e.g., a window). FIG. 1C depicts the motorized roller shade 100 with the covering material 122 in a lowered position. Rotation of the roller tube 112 in a second direction, about the axis or rotation AR, that is opposite the first direction may cause the covering material 122 to wind onto the roller tube 112, for example as the covering material 122 is operated to a raised position relative to the opening. FIG. 1B depicts the motorized roller shade 100, with the covering material 122 in a raised position.

The covering material 122 may be made of any suitable material, or combination of materials. For example, the covering material 122 may be made from one or more of "scrim," woven cloth, non-woven material, light-control film, screen, or mesh. The hembar 126 may be attached to the lower end 124 of the covering material 122, and may be weighted, such that the hembar 126 causes the covering material 122 to hang (e.g., vertically) in front of one or more windows.

The motor drive unit 118 may be configured to enable control of the rotation of the roller tube 112, for example by a user of the motorized roller shade 100. For example, a user of the motorized roller shade 100 may control the motor drive unit 118 such that the covering material 122 is moved to a desired position. The motor drive unit 118 may include a sensor that monitors a position of the roller tube 112. This may enable the motor drive unit 118 to track a position of the covering material 122 relative to respective upper and lower limits of the covering material 122. The upper and lower limits may be specified by an operator of the motorized roller shade 100, and may correspond to the raised and lowered positions of the covering material 122, respectively.

The motor drive unit 118 may be manually controlled (e.g., by actuating one or more buttons) and/or wirelessly controlled (e.g., using an infrared (IR) or radio frequency (RF) remote control unit). Examples of motor drive units for motorized roller shades are described in greater detail in U.S. Pat. No. 6,983,783, issued Jan. 10, 2006, entitled "Motorized Shade Control System," U.S. Pat. No. 7,839,109, issued Nov. 23, 2010, entitled "Method Of Controlling A Motorized Window Treatment," U.S. Pat. No. 8,950,461, issued Jan. 21, 2015, entitled "Motorized Window Treatment," and U.S. Patent Application Publication No. 2013/0153162, published Jun. 20, 2013, entitled "Battery-Powered Motorized Window Treatment Having A Service Position," the entire contents of each of which are incorporated herein by reference. It should be appreciated, however, that any motor drive unit or drive system may be used to control the roller tube 112.

The motorized roller shade 100 may include an antenna (not shown) that is configured to receive wireless signals (e.g., RF signals from a remote control device). The antenna may be in electrical communication with the motor drive unit 118 (e.g., via a control circuit or PCB), such that one or more wireless signals received from a remote control unit may cause the motor drive unit 118 to move the covering material 122 (e.g., between the lowered and raised positions). The antenna may be integrated with (e.g., pass through, be enclosed within, and/or be mounted to) one or more of the shade assembly 110, the battery compartment 130, the housing 140, or respective components thereof.

The battery compartment 130 may be configured to retain one or more batteries 132. The illustrated battery 132 may be, for example, a D cell (e.g., IEC R20) battery. One or more components of the motorized roller shade 100, such as the motor drive unit 118, may be powered by the one or more batteries 132. However, it should be appreciated that the motorized roller shade 100 is not limited to the illustrated battery-powered configuration. For example, the motorized roller shade 100 may be alternatively configured such that one or more components thereof, such as the motor drive unit 118, may be powered by an alternating current (AC) source, a direct current (DC) source, or any combination of power sources.

The battery compartment 130 may be configured to be operable between an opened position and a closed position, such that one or more batteries 132 may be accessible when the battery compartment 130 is in the opened position. Examples of battery compartments for motorized roller shades are described in greater detail in U.S. Patent Application Publication No. 2014/0305602, published Oct. 16, 2014, entitled "Integrated Accessible Battery Compartment For Motorized Window Treatment," the entire contents of which is incorporated herein by reference.

The housing 140 may be configured to support one or both of the shade assembly 110 and the battery compartment 130. For example, the first and second housing brackets 150, 160 may be configured to support the shade assembly 110 and/or the battery compartment 130. As shown, the first and second housing brackets 150, 160 are configured to support the shade assembly 110 and the battery compartment 130 such that the battery compartment 130 is located (e.g., is oriented) above the shade assembly 110 when the motorized roller shade 100 is mounted to a structure. It should be appreciated that the motorized roller shade 100 is not limited to the illustrated orientation of the shade assembly 110 and the battery compartment 130. For example, the housing 140 may be alternatively configured to otherwise support the shade assembly 110 and the battery compartment 130 relative to each other (e.g., such that the battery compartment 130 is located below the shade assembly 110).

As shown, the first housing bracket 150 defines an upper portion 151 and a lower portion 153, and the second housing bracket 160 defines an upper portion 161 and a lower portion 163. The upper portion 151 of the first housing bracket 150 may be configured to support a first end of the battery compartment 130, and the upper portion 161 of the second housing bracket 160 may be configured to support a second end of the battery compartment 130. The upper portions 151, 161 of the first and second housing brackets 150, 160, respectively, may be configured to operably support the support the battery compartment 130, such that the battery compartment 130 is operable to provide access to one or more batteries 132 when the motorized roller shade 100 is mounted to a structure.

The lower portion 153 of the first housing bracket 150 may be configured to support the idler 121, and thus the first end 113 of the tube body 114 of the roller tube 112. The lower portion 163 of the second housing bracket 160 may be configured to support the idler 120, and thus the second end 115 of the tube body 114 of the roller tube 112. The lower portions 153, 163 of the first and second housing brackets 150, 160, respectively, may be configured to operably support the support the shade assembly 110, such that the covering material 122 may be moved (e.g., between the lowered and raised positions). Because the roller tube 112 is supported at the first and second ends 113, 115 of the tube body 114, it may be stated that the shade assembly 110, and thus the roller tube 112, is simply supported by the housing 140.

The housing 140 may be configured to be mounted to a structure using one or more fasteners (e.g., one or more screws). For example, one or more of the rail 142, the first housing bracket 150, or the second housing bracket 160 may define one or more respective apertures that are configured to receive fasteners.

The components of the housing 140 may be made of any suitable material or combination of materials. For example, the rail 142 may be made of metal and the first and second housing brackets 150, 160 may be made of plastic. Although the illustrated housing 140 includes separate components, it should be appreciated that the housing 140 may be otherwise constructed. For example, the rail 142, the first housing bracket 150, and the second housing bracket 160 may be monolithic. In another example, the rail may include first and second rail sections that may be configured to attach to one another. In such an example configuration, the first rail section may include an integrated first housing bracket and the second rail section may include an integrated second housing bracket. One or more components of the housing 140 (e.g., one or more of the rail 142, the first housing bracket 150, or the second housing bracket 160) may be wrapped in a material (e.g., fabric), for instance to enhance the aesthetics of the housing 140.

The motorized roller shade 100 may be configured for use in covering an atypically large opening, such as a window, or cluster of windows, having a width greater than 8 feet, and up to about 15 feet wide, such as about 12 feet wide. In such an application, the roller tube 112 may be susceptible to an amount of tube sag that may negatively impact the aesthetic of the covering material 122 and/or the functionality of the motorized roller shade, such as raising or lowering the covering material 122. One or more components of the motorized roller shade 100 may be configured to mitigate the occurrence of tube sag. For example, the roller tube 112 may be configured as a low-deflection roller tube.

Figure 2A:
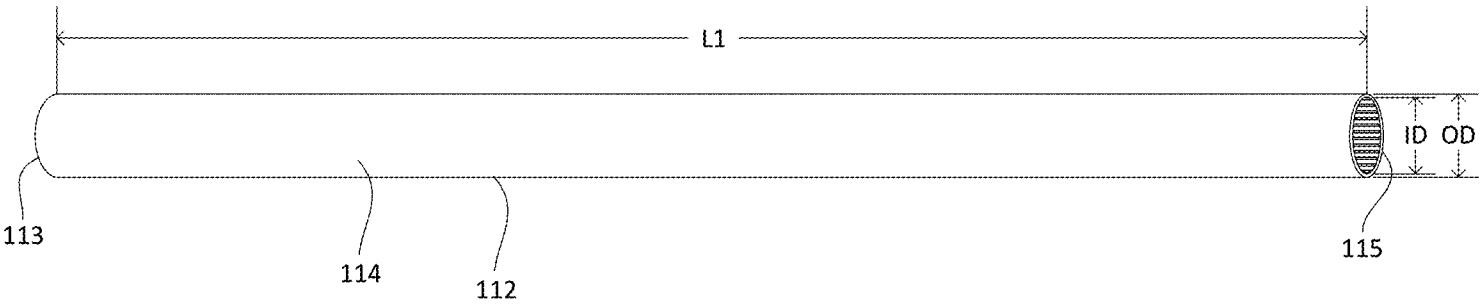
FIG. 2A is a perspective view of an example low-deflection roller tube, with the roller tube in an unloaded position.
Figure 2B:
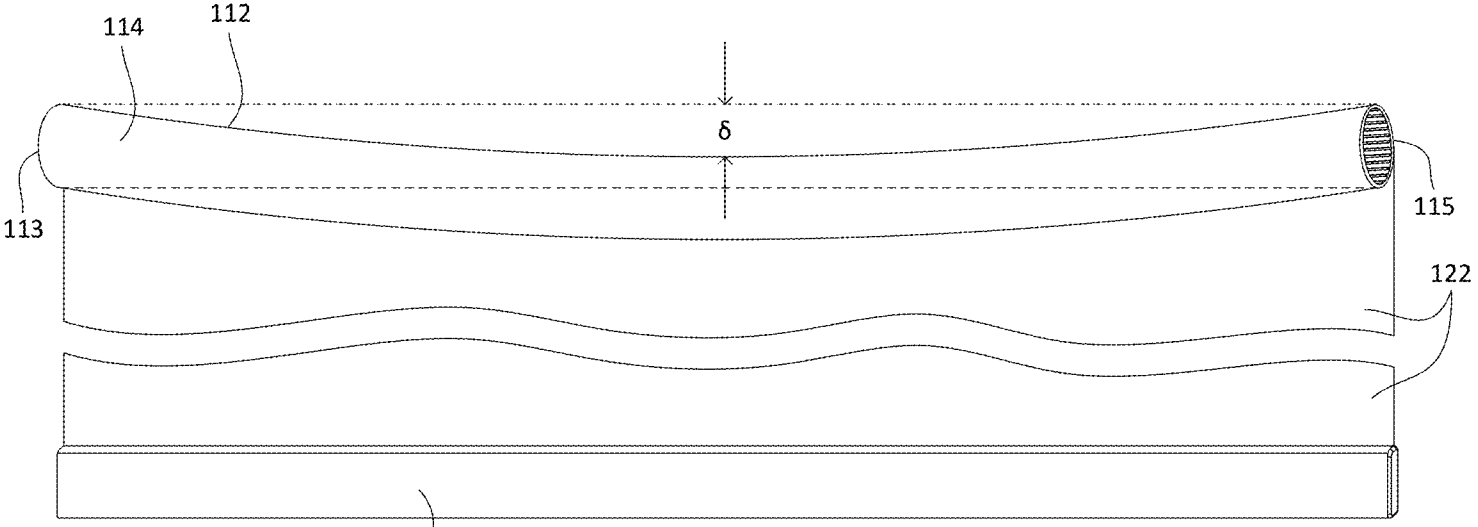
FIG. 2B is a perspective view of the example low-deflection roller tube depicted in FIG. 2A, depicting deflection of the roller tube when simply supported and with a covering material attached thereto.

FIGS. 2A and 2B depict an example low-deflection roller tube 112. The roller tube 112 may be used in covering a wide opening (e.g., an opening that is 8 feet wide or wider). As shown, the tube body 114 of the roller tube 112 may define a length L1 along the longitudinal direction L, for example defined by the first and second ends 113, 115 of the roller tube 112. The roller tube 112 may be configured such that an outer diameter OD of the tube body 114 does not exceed 2 inches, for example to maintain an aesthetic of the motorized roller shade 100, and/or to ensure that when the covering material 122 is fully wound onto the roller tube 112, the roller tube 112 and covering material 122 do not exceed a desired volume (e.g., the volume within a pocket in which the motorized roller shade 100 is installed). The tube body 114 may define an outer diameter OD of about 1.67 inches to about 2 inches, such as 2 exactly inches, and an inner diameter ID of about 1.53 inches to about 1.75 inches, such as exactly 1.75 inches.

FIG. 2A depicts the roller tube 112 in an unloaded position, for instance with the covering material 122 detached and the roller tube 112 separated from the housing 140. This position may be referred to a non-deflected, relaxed state of the roller tube 112. When the roller tube 112 is operably attached to the housing 140 (e.g., such that the first end 113 of the tube body 114 is supported by the lower portion 153 of the first housing bracket 150 and the second end 115 of the tube body 114 is supported by the lower portion 163 of the second housing bracket 160) and the covering material 122 is attached to the roller tube 112, one or more portions of the roller tube 112 may deflect downward, such that the roller tube 112 may exhibit tube sag, for example as shown in FIG. 2B. It should be appreciated that the deflection of the roller tube 112, as shown in FIG. 2B, is exaggerated for the purposes of illustration.

In accordance with a first example configuration of the roller tube 112, the roller tube 112 may define a length L1 of at least 10 feet, such as 10 feet. When the covering material 122 is attached to the roller tube 112 and the roller tube 112 is supported only at the first and second ends 113, 115, deflection δ of the tube body 114 does not exceed ⅛ of an inch at any location along the tube body 114, relative to the unloaded position of the roller tube 112.

In accordance with a second example configuration of the roller tube 112, the roller tube 112 may define a length L1 of at least 12 feet, such as 12 feet. When the covering material 122 is attached to the roller tube 112 and the roller tube 112 is supported only at the first and second ends 113, 115, deflection δ of the tube body 114 does not exceed ¼ of an inch at any location along the tube body 114, relative to the unloaded position of the roller tube 112.

In order to achieve the deflection characteristics of the example configurations of the roller tube 112, the tube body 114 may be constructed of a material that has high strength and low density, such as carbon fiber. For example, the tube body 114 may be constructed from one or more layers of carbon fiber material, such as a plurality of layers of carbon fiber fabric that are applied in succession, for example filament wound onto a mandrel, such that the tube body 114 is built-up via the layers of carbon fiber fabric. One or more of the carbon fiber fabric layers of the tube body 114 may comprise high modulus carbon fiber, for example that exhibits a tensile modulus of 55 million pounds per square inch (MSI) or higher.

Figure 3:
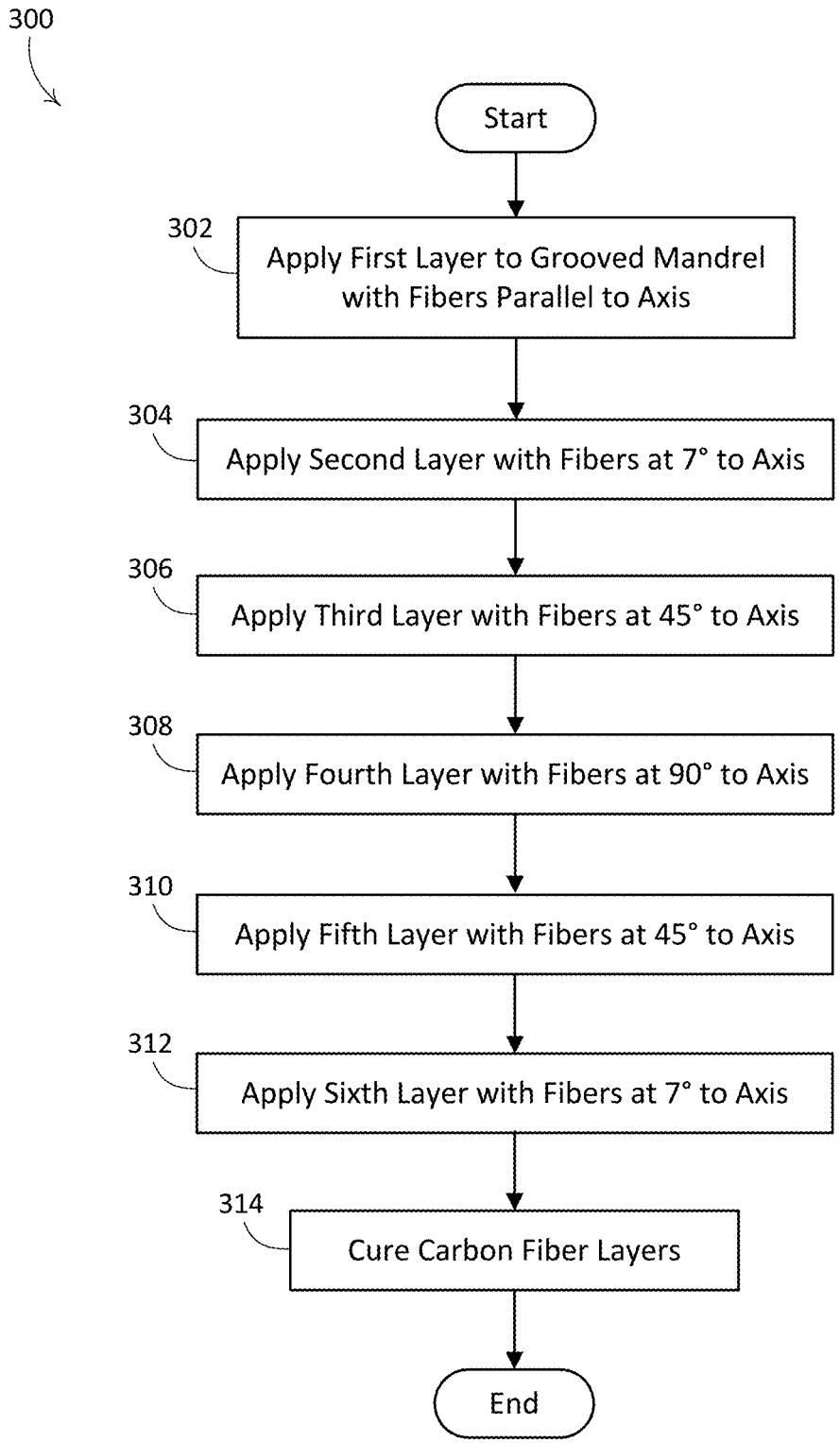
FIG. 3 depicts an example process for manufacturing a low-deflection roller tube.

FIG. 3 depicts an example process 300 for constructing an example low-deflection carbon fiber roller tube, such as the roller tube 112 depicted in FIGS. 2A and 2B, for example. In accordance with the example process 300, one or more layers of carbon fiber material (e.g., carbon fiber fabric) may be applied to a mandrel, in order to additively construct the tube body 114 of the roller tube 112. The mandrel may have a solid, cylindrical shaped mandrel body that extends along a central axis from a first end to an opposed second end. The central axis of the mandrel may extend parallel to the longitudinal direction L, and may be coincident with the axis or rotation AR of the roller tube 112.

The mandrel body may define a plurality of grooves that extend into an outer peripheral surface of the mandrel body. The grooves may extend parallel to the central axis of the mandrel body, and may be spaced apart from each other equally or unequally along a circumference of the outer surface. The grooves may extend along substantially an entirety of a length of the mandrel. The mandrel may be tapered between the first and second ends, to facilitate removal of the finished roller tube 112 from the mandrel. For example, the mandrel may preferably be tapered at about 1/1000 of an inch per foot of length of the mandrel, from the first end to the second end.

Figure 7A:
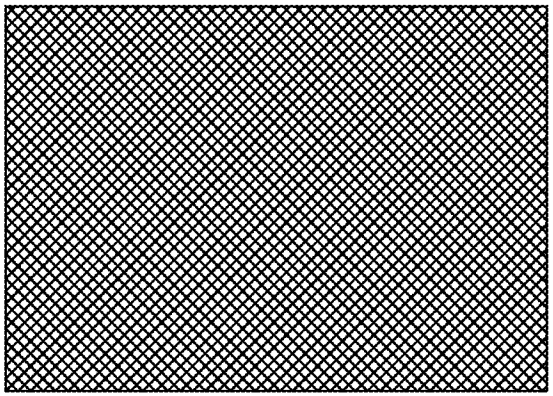
FIGS. 7A-7D depict the respective carbon fiber weave patterns of example layers of carbon fiber fabric that may be used in the example processes depicted in FIGS. 3 and 6.

At 302, a first layer of carbon fiber fabric may be applied to the mandrel. The first layer of carbon fiber fabric may comprise, for example, low modulus carbon fiber (e.g., exhibiting a tensile modulus of about 34 MSI), intermediate modulus carbon fiber (e.g., exhibiting a tensile modulus of about 42 MSI), or the like. During application to the mandrel, the first layer of carbon fiber fabric may be oriented such that fibers of the first layer of carbon fiber fabric are parallel to the central axis of the mandrel (e.g., as shown in FIG. 7A). Stated differently, the first layer of carbon fiber fabric may be oriented such that fibers of the first layer of carbon fiber fabric are not angularly offset relative to the central axis of the mandrel. The first layer of carbon fiber fabric may be applied to the mandrel such that carbon fiber fabric is disposed into (e.g., pressed into) each of the grooves of the mandrel body. The carbon fiber fabric disposed in the grooves of the mandrel body may form the splines 117 of the tube body 114 of the roller tube 112.

Figure 7B:
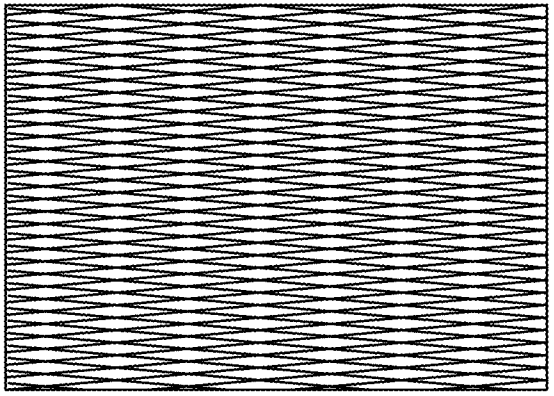

One or more additional layers of carbon fiber fabric may be applied to the first layer of carbon fiber fabric, so as to additively construct the tube body 114 of the roller tube 112. For example, at 304, a second layer of carbon fiber fabric may be applied to the first layer of carbon fiber fabric (e.g., on top of the first layer of carbon fiber fabric). The second layer of carbon fiber fabric may comprise, for example, low modulus carbon fiber, intermediate modulus carbon fiber, or the like. The second layer of carbon fiber fabric may be oriented such that fibers of the second layer of carbon fiber fabric are angularly offset by a shallow angle, for example by approximately 5° to 10°, such as by about 7°, relative to the central axis of the mandrel (e.g., as shown in FIG. 7B). The second layer of carbon fiber fabric may enhance one or more stiffness characteristics of the roller tube 112.

Figure 7C:
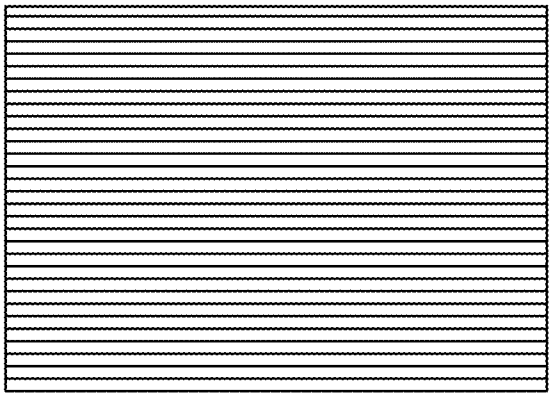

At 306, a third layer of carbon fiber fabric may be applied to the second layer of carbon fiber fabric (e.g., on top of the second layer of carbon fiber fabric). The third layer of carbon fiber fabric may comprise, for example, low modulus carbon fiber, intermediate modulus carbon fiber, or the like. The third layer of carbon fiber fabric may be oriented such that fibers of the third layer of carbon fiber fabric are angularly offset by approximately 30° to 45°, such as by about 45°, relative to the central axis of the mandrel (e.g., as shown in FIG. 7C). The third layer of carbon fiber fabric may serve as a transition layer, for example between the second layer of carbon fiber fabric and a fourth layer of carbon fiber fabric.

Figure 7D:
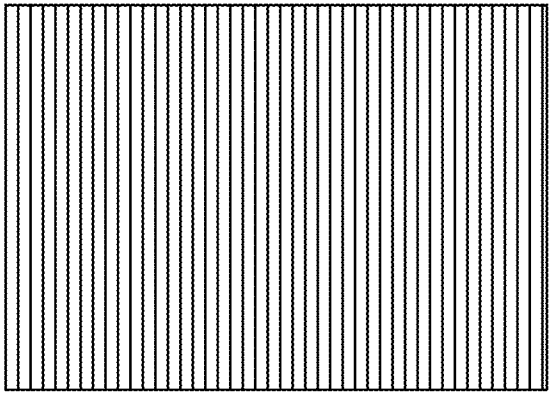

At 308, a fourth layer of carbon fiber fabric may be applied to the third layer of carbon fiber fabric (e.g., on top of the third layer of carbon fiber fabric). The fourth layer of carbon fiber fabric may comprise, for example, low modulus carbon fiber, intermediate modulus carbon fiber, or the like. The fourth layer of carbon fiber fabric may be oriented such that fibers of the fourth layer of carbon fiber fabric are angularly offset by about 60° to 90°, such as by about 90°, relative to the central axis of the mandrel. Stated differently, the fourth layer of carbon fiber fabric may be oriented such that fibers of the fourth layer of carbon fiber fabric are perpendicular to the central axis of the mandrel (e.g., as shown in FIG. 7D). The fourth layer of carbon fiber fabric may enhance cracking resistance of the roller tube 112.

At 310, a fifth layer of carbon fiber fabric may be applied to the fourth layer of carbon fiber fabric (e.g., on top of the fourth layer of carbon fiber fabric). The fifth layer of carbon fiber fabric may comprise, for example, low modulus carbon fiber, intermediate modulus carbon fiber, or the like. The fifth layer of carbon fiber fabric may be oriented such that fibers of the fifth layer of carbon fiber fabric are angularly offset by approximately 30° to 45°, such as by about 45°, relative to the central axis of the mandrel (e.g., as shown in FIG. 7C). The fifth layer of carbon fiber fabric may be further oriented such that fibers of the fifth layer of carbon fiber fabric are aligned with fibers of the third layer of carbon fiber fabric, for example such that the fibers of the fifth layer of carbon fiber fabric are symmetric with the fibers of the third layer of carbon fiber fabric. The fifth layer of carbon fiber fabric may serve as a transition layer, for example between the fourth layer of carbon fiber fabric and a sixth layer of carbon fiber fabric.

At 312, a sixth layer of carbon fiber fabric may be applied to the fifth layer of carbon fiber fabric (e.g., on top of the fifth layer of carbon fiber fabric). The sixth layer of carbon fiber fabric may comprise, for example, low modulus carbon fiber, intermediate modulus carbon fiber, or the like. The sixth layer of carbon fiber fabric may be oriented such that fibers of the sixth layer of carbon fiber fabric are angularly offset by approximately 5° to 10°, such as by about 7°, relative to the central axis of the mandrel (e.g., as shown in FIG. 7B). The sixth layer of carbon fiber fabric may be further oriented such that fibers of the sixth layer of carbon fiber fabric are aligned with fibers of the second layer of carbon fiber fabric, for example such that the fibers of the sixth layer of carbon fiber fabric are symmetric with the fibers of the second layer of carbon fiber fabric. The sixth layer of carbon fiber fabric may comprise high modulus carbon fiber. Accordingly, at least one layer of carbon fiber fabric of the tube body 114, such as the outermost layer of carbon fiber fabric, may comprise high modulus carbon fiber. The sixth layer of carbon fiber fabric may further enhance one or more stiffness characteristics of the roller tube 112.

At 314, the first, second, third, fourth, fifth, and sixth layers of carbon fiber fabric may be cured. Once the layers of carbon fiber fabric are cured, the mandrel may be removed from the roller tube 112, for example by biasing the thicker first end of the mandrel out of the roller tube 112. In accordance with the example process 300, the first, third, fourth, and fifth layers of carbon fiber fabric may be of approximately the same thickness, and may be thinner than the second and sixth layers of carbon fiber fabric. The second and sixth layers of carbon fiber fabric may be of approximately the same thickness.

It should be appreciated that in accordance with the illustrated example process 300, the first, second, third, fourth, and fifth layers of carbon fiber fabric may comprise low modulus carbon fiber, intermediate modulus carbon fiber, or the like, in any combination. It should further be appreciated that the sixth layer of carbon fiber fabric is not limited to high modulus carbon fiber. For example, the sixth layer of carbon fiber fabric may alternatively comprise low modulus carbon fiber, intermediate modulus carbon fiber, or the like.

It should further still be appreciated that manufacture of the roller tube 112 is not limited to the example process 300. For example, the tube body 114 of the roller tube 112 may be alternatively constructed using more or fewer layers of carbon fiber fabric, having any suitable combination of modulus types, fiber orientations relative to each other and to the central axis of the mandrel, and thicknesses. It should further still be appreciated that the mandrel is not limited to grooves that will produce the illustrated splines 117 of the tube body 114. For example, the mandrel may be alternatively configured to differently configure the inner surface 116 to operatively engage with the motor drive unit 118. Alternatively still, the mandrel may be smooth, such that the tube body 114 of the resulting roller tube 112 may define a smooth inner surface 116.

Figure 4:
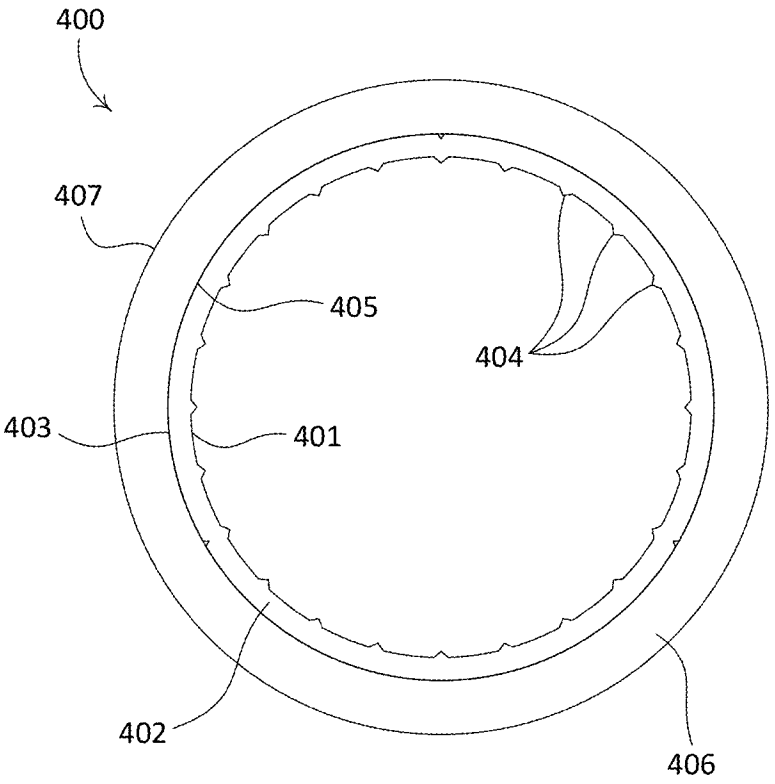
FIG. 4 is an end view of another example low-deflection roller tube.

FIG. 4 depicts an end view of another example low-deflection roller tube 400. The roller tube 400 may be used in covering a wide opening (e.g., an opening that is 8 feet wide or wider). The roller tube 400 may be implemented, for example, in the motorized roller shade 100 (e.g., in the place of the roller tube 112). As shown, the roller tube 400 may be a two-part roller tube that includes a first tube 402 and a second tube 406. The first tube 402 may be referred to as an inner tube of the roller tube 400, and the second tube 406 may be referred to as an outer tube of the roller tube 400. The first and second tubes 402, 406 may be elongate between respective opposed first and second ends that are spaced apart from each other along the longitudinal direction L. The first and second tubes 402, 406 may be of the same or different lengths (e.g., as defined by the respective first and second ends). The first tube 402 may be made of any suitable material, such as aluminum, steel, or the like.

The first tube 402 may define an inner surface 401 and an opposed outer surface 403 that is radially spaced from the inner surface 401. The inner surface 401 of the first tube 402 may be configured to operatively engage with a motor drive unit, such as the motor drive unit 118 of the motorized roller shade 100. For example, as shown, the first tube 402 defines a plurality of splines 404 that extend radially inward from the inner surface 401. The roller tube 400 may be configured to operatively engage with the motor drive unit 118 via the plurality of splines 404. For example, the splines 404 may be configured to operatively engage with respective grooves of the drive hub 119 and the idler 121.

The splines 404 may extend parallel to the longitudinal direction L, and may be spaced apart from each other equally, as shown, or unequally along a circumference of the inner surface 401 of the first tube 402. Each of the illustrated splines 404 may extend from the first end to the second end of the first tube 402. It should be appreciated that the first tube 402 is not limited to illustrated configuration and/or geometry of splines 404. It should further be appreciated that the first tube 402 may be alternatively configured to operably engage with the motor drive unit 118.

The second tube 406 may be made of a different material than the first tube 402. In this regard, the roller tube 400 may be referred to as a hybrid roller tube. As shown, the second tube 406 may be made of a carbon fiber material. The second tube 406 may define an inner surface 405 and an opposed outer surface 407 that is radially spaced from the inner surface 405. The second tube 406 may be attached to the first tube 402. For example, the second tube 406 may be constructed from one or more layers of carbon fiber material, such as a plurality of layers of carbon fiber fabric that are applied in succession, for example filament wound, onto the outer surface 403 of the first tube 402 such that the second tube 406 is built-up via the layers of carbon fiber fabric. For example, the second tube 406 may be constructed in accordance with the example process 600 depicted in FIG. 6. One or more of the carbon fiber fabric layers of the second tube 406 may comprise high modulus carbon fiber, for example that exhibits a tensile modulus of 55 million pounds per square inch (MSI) or higher. In accordance with an example construction in which the second tube 406 is filament wound onto the first tube 402, the inner surface 405 of the second tube 406 may be attached to the outer surface 403 of the first tube 402, for example during a curing process of the carbon fiber material.

One or both of the first and second tubes 402, 406 may be configured such that an outer diameter OD of the second tube 406, and thus of the roller tube 400, does not exceed 2 inches, for example to maintain an aesthetic of the motorized roller shade 100, and/or to ensure that when the covering material 122 is fully wound onto the roller tube 400, the roller tube 400 and covering material 122 do not exceed a desired volume (e.g., the volume within a pocket in which the motorized roller shade 100 is installed). The second tube 406 may define an outer diameter OD of about 1.67 inches to 2 inches, such as 2 inches for example.

Figure 5:
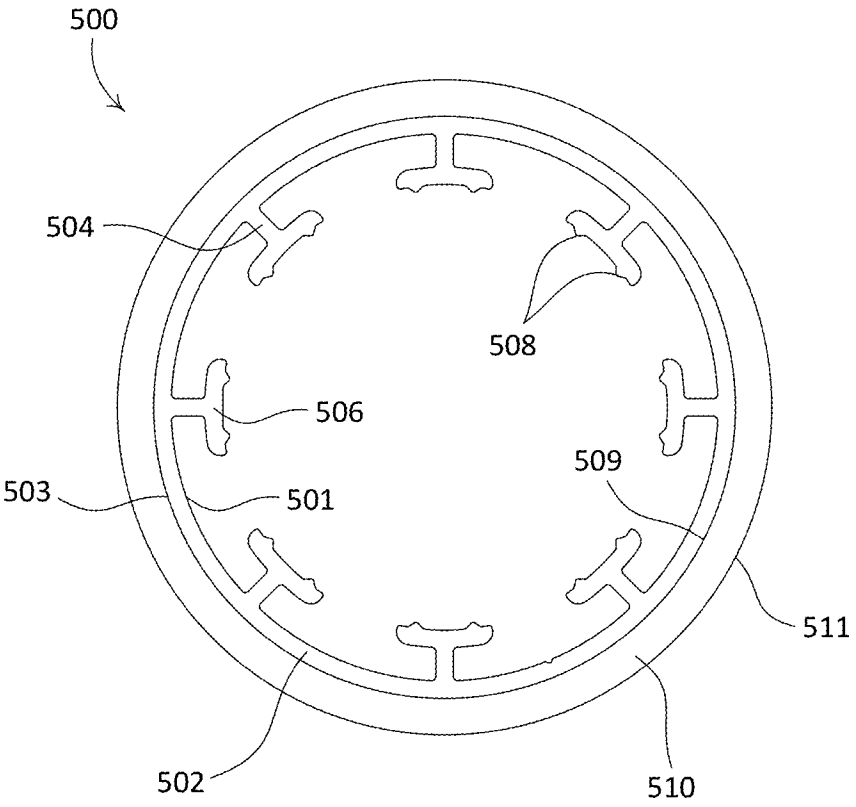
FIG. 5 is an end view of still another example low-deflection roller tube.

FIG. 5 depicts an end view of still another example low-deflection roller tube 500. The roller tube 500 may be used in covering a wide opening (e.g., an opening that is 8 feet wide or wider). The roller tube 500 may be implemented, for example, in the motorized roller shade 100 (e.g., in the place of the roller tube 112). As shown, the roller tube 500 may be a two-part roller tube that includes a first tube 502 and a second tube 510. The first tube 502 may be referred to as an inner tube of the roller tube 500, and the second tube 510 may be referred to as an outer tube of the roller tube 500. The first and second tubes 502, 510 may be elongate between respective opposed first and second ends that are spaced apart from each other along the longitudinal direction L. The first and second tubes 502, 510 may be of the same or different lengths (e.g., as defined by the respective first and second ends). The first tube 502 may be made of any suitable material, such as aluminum, steel, or the like.

The first tube 502 may define an inner surface 501 and an opposed outer surface 503 that is radially spaced from the inner surface 501. The first tube 502 may be configured to operatively engage with a motor drive unit, such as the motor drive unit 118 of the motorized roller shade 100. For example, the first tube 502 may define one or more engagement members that extend from the inner surface 501. As shown, the first tube 502 may define a plurality of engagement arms 504 that extend radially inward from the inner surface 501, and that extend between the first and second ends of the first tube 502, for example from the first end to the second end. Each engagement arm 504 may include an engagement pad 506 that defines one or more splines 507. The engagement pads 506 may be spaced from the inner surface 501, such that the second tube 510 is located in a favorable location to maximize a moment of inertia of the second tube 510. As shown, each engagement pad 506 defines a pair of splines 508. The roller tube 500 may be configured to operatively engage with the motor drive unit 118 via the plurality of splines 508. For example, the splines 508 may be configured to operatively engage with respective grooves of the drive hub 119 and the idler 121.

The splines 508 may extend parallel to the longitudinal direction L. The engagement arms 504 may be spaced apart from each other equally, as shown, or unequally along a circumference of the inner surface 501 of the first tube 502. Each of the illustrated splines 508 may extend from the first end to the second end of the first tube 502. It should be appreciated that the first tube 502 is not limited to illustrated configuration and/or geometry of engagement members (e.g., engagement arms 504) and/or splines 508. It should further be appreciated that the first tube 502 may be alternatively configured to operably engage with the motor drive unit 118.

The second tube 510 may be made of a different material than the first tube 502. In this regard, the roller tube 500 may be referred to as a hybrid roller tube. As shown, the second tube 510 may be made of a carbon fiber material. The second tube 510 may define an inner surface 509 and an opposed outer surface 511 that is radially spaced from the inner surface 509. The second tube 510 may be attached to the first tube 502. For example, the second tube 510 may be constructed from one or more layers of carbon fiber material, such as a plurality of layers of carbon fiber fabric that are applied in succession, for example filament wound, onto the outer surface 503 of the first tube 502 such that the second tube 510 is built-up via the layers of carbon fiber fabric. For example, the second tube 510 may be constructed in accordance with the example process 600 depicted in FIG. 6. One or more of the carbon fiber fabric layers of the second tube 510 may comprise high modulus carbon fiber, for example that exhibits a tensile modulus of 55 million pounds per square inch (MSI) or higher. In accordance with an example construction in which the second tube 510 is filament wound onto the first tube 502, the inner surface 509 of the second tube 510 may be attached to the outer surface 503 of the first tube 502, for example during a curing process of the carbon fiber material.

One or both of the first and second tubes 502, 510 may be configured such that an outer diameter OD of the second tube 510, and thus of the roller tube 500, does not exceed 2 inches, for example to maintain an aesthetic of the motorized roller shade 100, and/or to ensure that when the covering material 122 is fully wound onto the roller tube 500, the roller tube 500 and covering material 122 do not exceed a desired volume (e.g., the volume within a pocket in which the motorized roller shade 100 is installed). The second tube 510 may define an outer diameter OD of about 1.67 inches to 2 inches, such as 2 inches for example.

Constructing a roller tube as a hybrid roller tube, such as the roller tube 400 or the roller tube 500 that may include respective first tubes that are made of aluminum and second tubes that are made of carbon fiber, may reduce manufacturing and/or material costs in comparison to the construction of a roller tube made of carbon fiber, such as the roller tube 112. For example, the roller tubes 400 and 500 may be made of less carbon fiber material than the roller tube 112, for instance by using fewer and/or thinner layers of carbon fiber material. Additionally, the manufacturing process of the roller tubes 400 and 500 may be simpler than that of the roller tube 112, for instance because the step of removing a mandrel from the finished roller tube is omitted. Moreover, additively constructing the carbon fiber portion of a roller tube on the outer surface of first tube that is not made of carbon fiber may allow the enhanced stiffness and other advantageous properties contributed by the carbon fiber material to be located where a maximum benefit will be derived therefrom (e.g., proximate the outer surface of the roller tube).

Figure 6:
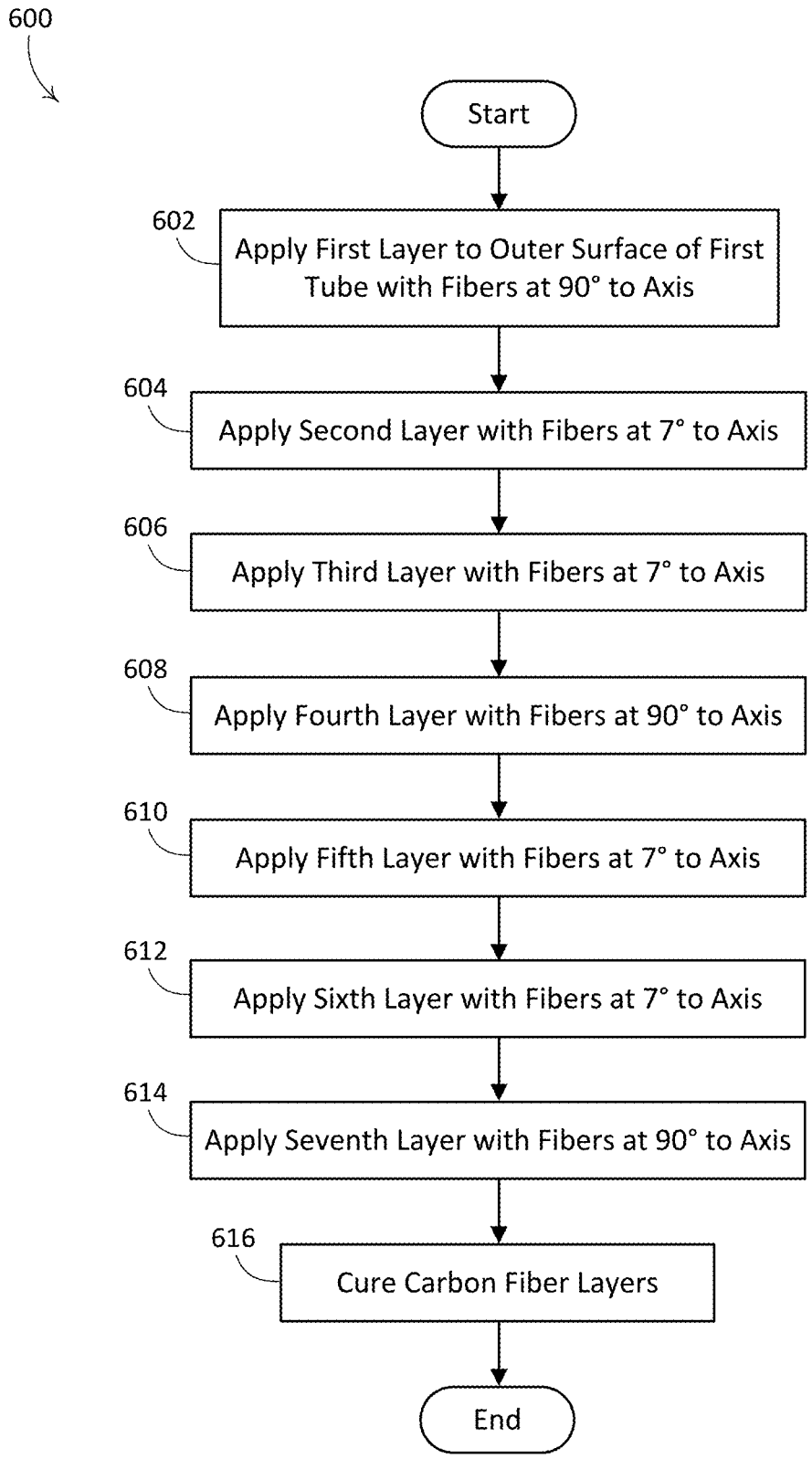
FIG. 6 depicts another example process for manufacturing a low-deflection roller tube.

FIG. 6 depicts another example process 600 for constructing an example low-deflection carbon fiber roller tube, such as the roller tubes 400 and 500 depicted in FIGS. 4 and 5, respectively. In accordance with the example process 600, one or more layers of carbon fiber material (e.g., carbon fiber fabric) may be applied to a first tube (e.g., the first tube 402 or the first tube 502) in order to additively construct a second tube (e.g., the second tube 406 or the second tube 510) on the first tube. The first tube may define a hollow cylindrical body that extends along a central axis from a first end to an opposed second end. The central axis of the first tube may extend parallel to the longitudinal direction L, and may be coincident with the axis or rotation AR. The first tube may be made of any suitable material, such as aluminum or the like. The first tube may define a substantially smooth outer surface.

At 602, a first layer of carbon fiber fabric may be applied to the first tube. The first layer of carbon fiber fabric may comprise, for example, low modulus carbon fiber (e.g., exhibiting a tensile modulus of about 34 MSI), intermediate modulus carbon fiber (e.g., exhibiting a tensile modulus of about 42 MSI), or the like. During application to the first tube, the first layer of carbon fiber fabric may be oriented such that fibers of the first layer of carbon fiber fabric are angularly offset by about 60° to 90°, such as by about 90°, relative to the central axis of the first tube. Stated differently, the first layer of carbon fiber fabric may be oriented such that fibers of the first layer of carbon fiber fabric are perpendicular to the central axis of the first tube (e.g., as shown in FIG. 7D).

One or more additional layers of carbon fiber fabric may be applied to the first layer of carbon fiber fabric, so as to additively construct the second tube. For example, at 604, a second layer of carbon fiber fabric may be applied to the first layer of carbon fiber fabric (e.g., on top of the first layer of carbon fiber fabric). The second layer of carbon fiber fabric may comprise, for example, low modulus carbon fiber, intermediate modulus carbon fiber, or the like. The second layer of carbon fiber fabric may be oriented such that fibers of the second layer of carbon fiber fabric are angularly offset by a shallow angle, for example by approximately 5° to 10°, such as by about 7°, relative to the central axis of the first tube (e.g., as shown in FIG. 7B). The second layer of carbon fiber fabric may enhance one or more stiffness characteristics of the roller tube.

At 606, a third layer of carbon fiber fabric may be applied to the second layer of carbon fiber fabric (e.g., on top of the second layer of carbon fiber fabric). The third layer of carbon fiber fabric may comprise, for example, low modulus carbon fiber, intermediate modulus carbon fiber, or the like. The third layer of carbon fiber fabric may be oriented such that fibers of the third layer of carbon fiber fabric are angularly offset by a shallow angle, for example by approximately 5° to 10°, such as by about 7°, relative to the central axis of the first tube (e.g., as shown in FIG. 7B). The third layer of carbon fiber fabric may enhance one or more stiffness characteristics of the roller tube.

At 608, a fourth layer of carbon fiber fabric may be applied to the third layer of carbon fiber fabric (e.g., on top of the third layer of carbon fiber fabric). The fourth layer of carbon fiber fabric may comprise, for example, low modulus carbon fiber, intermediate modulus carbon fiber, or the like. The fourth layer of carbon fiber fabric may be oriented such that fibers of the fourth layer of carbon fiber fabric are angularly offset by about 60° to 90°, such as by about 90°, relative to the central axis of the first tube (e.g., as shown in FIG. 7D). The fourth layer of carbon fiber fabric may enhance cracking resistance of the roller tube.

At 610, a fifth layer of carbon fiber fabric may be applied to the fourth layer of carbon fiber fabric (e.g., on top of the fourth layer of carbon fiber fabric). The fifth layer of carbon fiber fabric may comprise, for example, low modulus carbon fiber, intermediate modulus carbon fiber, or the like. The fifth layer of carbon fiber fabric may be oriented such that fibers of the fifth layer of carbon fiber fabric are angularly offset by a shallow angle, for example by approximately 5° to 10°, such as by about 7°, relative to the central axis of the first tube (e.g., as shown in FIG. 7B). The fifth layer of carbon fiber fabric may enhance one or more stiffness characteristics of the roller tube.

At 612, a sixth layer of carbon fiber fabric may be applied to the fifth layer of carbon fiber fabric (e.g., on top of the fifth layer of carbon fiber fabric). The sixth layer of carbon fiber fabric may comprise, for example, low modulus carbon fiber, intermediate modulus carbon fiber, or the like. The sixth layer of carbon fiber fabric may be oriented such that fibers of the sixth layer of carbon fiber fabric are angularly offset by a shallow angle, for example by approximately 5° to 10°, such as by about 7°, relative to the central axis of the first tube (e.g., as shown in FIG. 7B). The sixth layer of carbon fiber fabric may enhance one or more stiffness characteristics of the roller tube.

At 614, a seventh layer of carbon fiber fabric may be applied to the sixth layer of carbon fiber fabric (e.g., on top of the sixth layer of carbon fiber fabric). The seventh layer of carbon fiber fabric may be oriented such that fibers of the seventh layer of carbon fiber fabric are angularly offset by about 60° to 90°, such as by about 90°, relative to the central axis of the first tube (e.g., as shown in FIG. 7D). The seventh layer of carbon fiber fabric may comprise high modulus carbon fiber. Accordingly, at least one layer of carbon fiber fabric of the second tube, such as the outermost layer of carbon fiber fabric, may comprise high modulus carbon fiber. The seventh layer of carbon fiber fabric may further enhance one or more stiffness characteristics of the roller tube.

At 616, the first, second, third, fourth, fifth, sixth, and seventh layers of carbon fiber fabric may be cured. During curing of the layers of carbon fiber fabric, the second tube may attach to (e.g., bond with) the outer surface of the first tube. The first, second, third, fourth, fifth, sixth, and seventh layers of carbon fiber fabric may be of approximately the same thickness or may have differing thicknesses.

It should be appreciated that in accordance with the illustrated example process 600, the first, second, third, fourth, fifth, and sixth layers of carbon fiber fabric may comprise low modulus carbon fiber, intermediate modulus carbon fiber, or the like, in any combination. It should further be appreciated that the seventh layer of carbon fiber fabric is not limited to high modulus carbon fiber. For example, the seventh layer of carbon fiber fabric may alternatively comprise low modulus carbon fiber, intermediate modulus carbon fiber, or the like.

It should further still be appreciated that manufacture of the roller tube is not limited to the example process 600. For example, the second tube of the roller tube may be alternatively constructed using more or fewer layers of carbon fiber fabric, having any suitable combination of modulus types, fiber orientations relative to each other and to the central axis of the first tube, and thicknesses.

Figure 8:
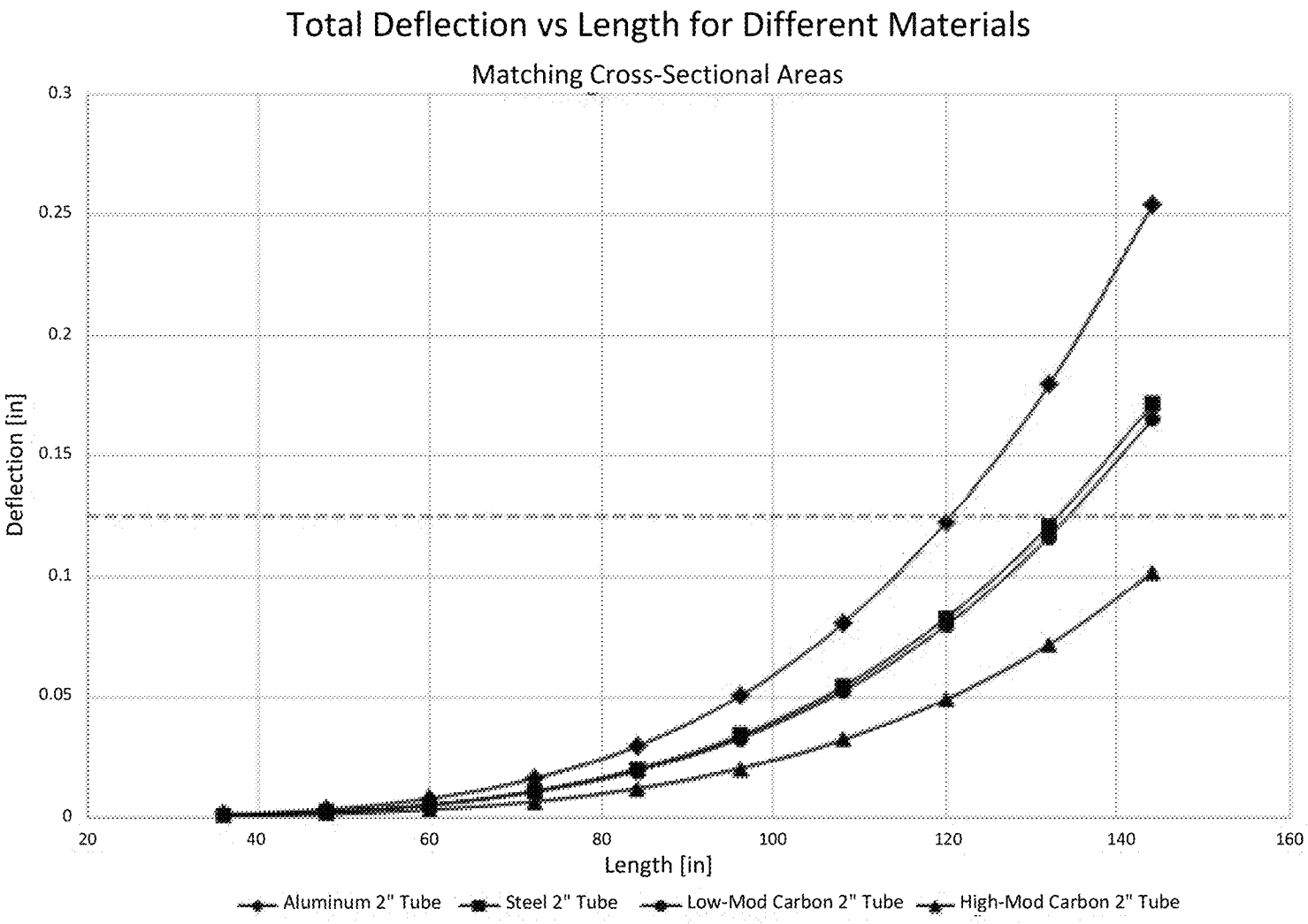
FIG. 8 is a graph depicting total deflection versus length for roller tubes of various materials.
Figure 9:
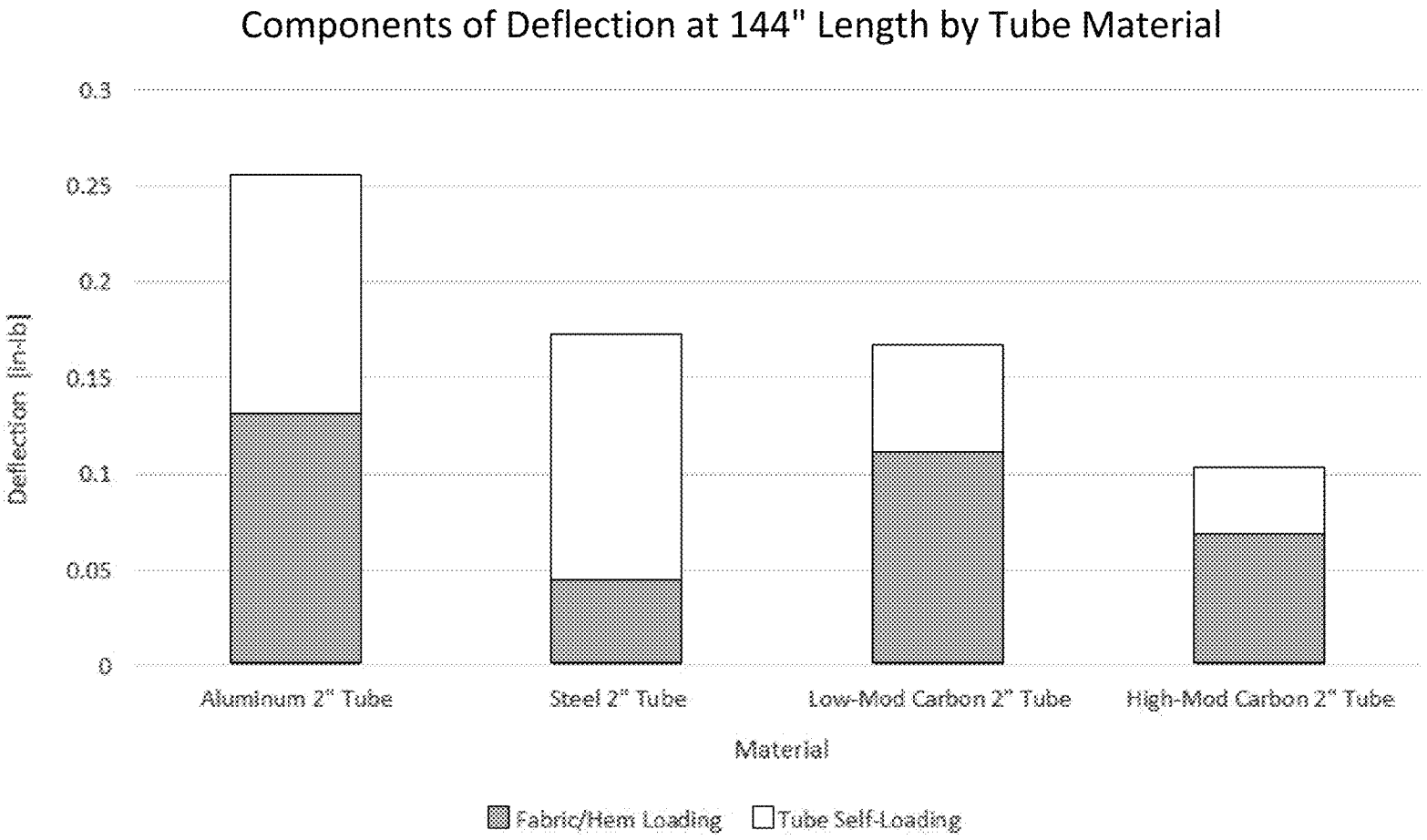
FIG. 9 is a graph depicting components of deflection at 12 foot tube length for roller tubes of various materials.
Figure 10:
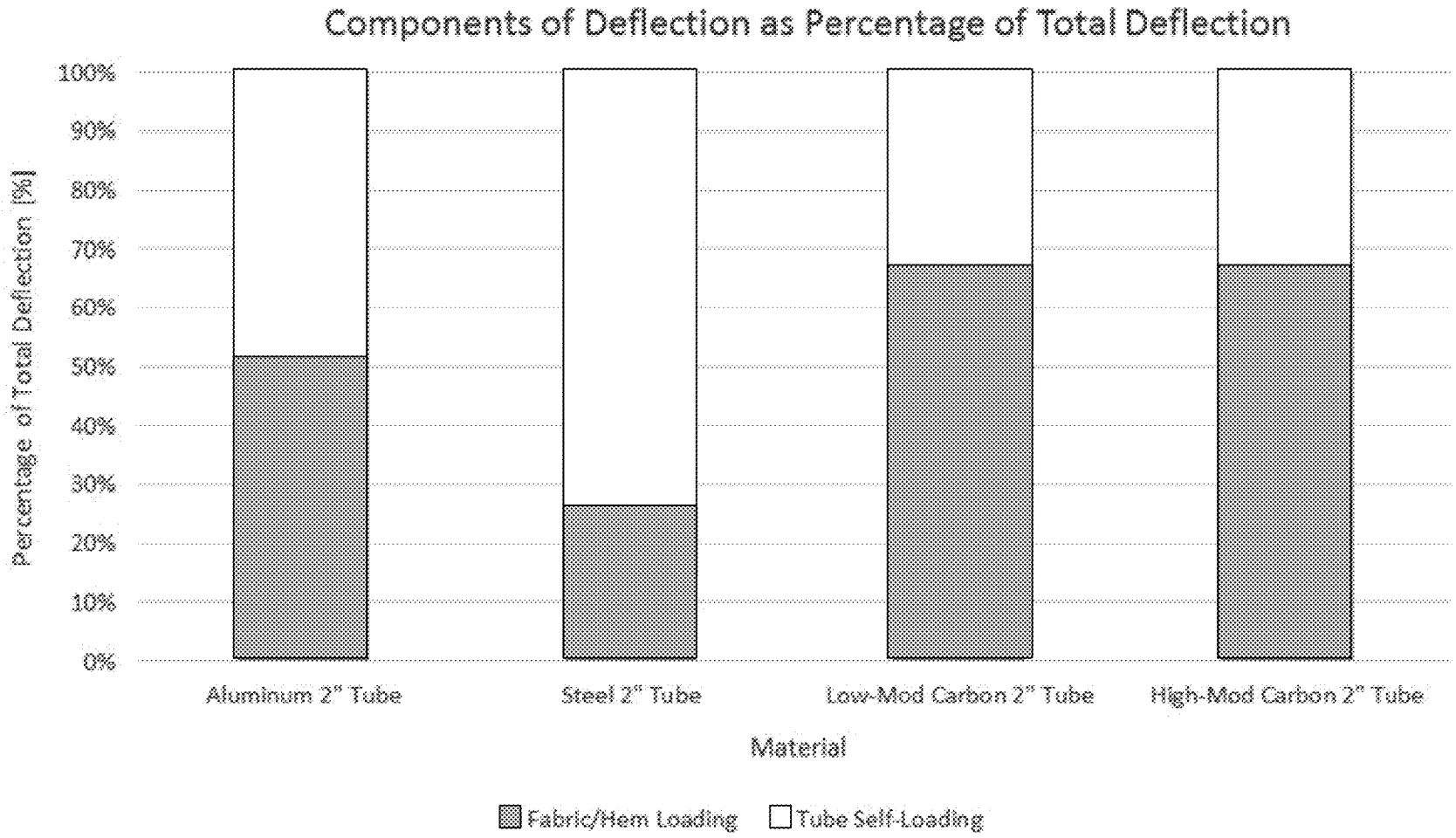
FIG. 10 is a graph depicting components of deflection as percentage of total deflection for roller tubes of various materials.

FIG. 8 is a graph depicting total deflection versus length for roller tubes of various materials. FIG. 9 is a graph depicting components of deflection at 12 foot tube length for roller tubes of various materials. FIG. 10 is a graph depicting components of deflection as percentage of total deflection for roller tubes of various materials.

It should be appreciated that the example motorized roller shade 100 illustrated and described herein is not limited to use as a window treatment, and that the motorized roller shade 100 may be implemented for uses other than covering openings (e.g., windows). For instance, the example motorized roller shade 100 having a low-deflection carbon fiber roller tube may be alternatively configured to function as a motorized projection screens (e.g., by replacing the covering material with a projection screen material).

The invention claimed is:

1. A motorized window treatment comprising:

a roller tube comprising:

a first tube comprising aluminum or steel, the first tube having an outer surface and an inner surface, and defining a single cylindrical void delimited by the inner surface; and a second tube, concentric to the first tube, the second tube comprising carbon fiber additively constructed on an outer surface of the first tube, wherein the second tube comprises an innermost layer of carbon fiber material bonded to the first tube, an intermediate layer of carbon fiber material bonded to the innermost layer, and an outermost layer of carbon fiber material that surrounds the intermediate layer and the innermost layer, wherein the innermost layer and the outermost layer are each oriented such that fibers of the respective layers have a same alignment relative to a longitudinal axis of the first tube, and an alignment of the intermediate layer is different from the alignment of the innermost layer and the outermost layer; and a covering material attached to the outermost layer of carbon fiber material of the second tube, the covering material operable between a raised position and a lowered position via rotation of the roller tube by a battery operated motor drive unit;

wherein the roller tube is supported only at its distal ends, has a length of at least ten feet along the longitudinal axis of the first tube, and an outer diameter that does not exceed two inches, and wherein a load comprising a weight of the roller tube and a weight of the covering material causes the roller tube to deflect no more than one eighth of an inch from the longitudinal axis of the first tube.

2. The motorized window treatment of claim 1, wherein a portion of the load from the weight of the covering material is greater than a portion of the load from the weight of the roller tube.

3. The motorized window treatment of claim 1, wherein the length of the roller tube is about twelve feet.

4. The motorized window treatment of claim 1, wherein at least one of the innermost layer and the intermediate layer exhibits a tensile modulus of 34 million pounds per square inch (MSI) or higher.

5. The motorized window treatment of claim 1, wherein at least one of the innermost layer and the intermediate layer exhibits a tensile modulus of 42 MSI or higher.

6. The motorized window treatment of claim 1, wherein the outermost layer exhibits a tensile modulus of 55 million MSI or higher.

7. The motorized window treatment of claim 1, wherein the innermost layer and the outermost layer are oriented such that fibers of the innermost layer and outermost layer are aligned approximately sixty to ninety degrees to the longitudinal axis of the first tube.

8. The motorized window treatment of claim 7, wherein the intermediate layer is oriented such that fibers of the at least one intermediate layer are aligned approximately five to ten degrees from the longitudinal axis of the first tube.

9. The motorized window treatment of claim 1, wherein the intermediate layer comprises a first intermediate layer, the roller tube further comprising a second intermediate layer adjacent to the first intermediate layer and surrounded by the outermost layer.

10. The motorized window treatment of claim 9, wherein fibers of the first and second adjacent intermediate layers have a same alignment, wherein the alignment of each of the first and second adjacent intermediate layers is different from the alignment of the innermost layer and the outermost layer, and wherein the first intermediate layer is bonded to the innermost layer and the second intermediate layer is bonded to the first intermediate layer.

11. The motorized window treatment of claim 9, wherein the first and second adjacent intermediate layers are oriented such that fibers of the first and second adjacent intermediate layers are aligned approximately five to ten degrees from the longitudinal axis of the first tube.

12. The motorized window treatment of claim 1, wherein the second tube is bonded to the first tube via curing of the layers of carbon fiber material.

13. The motorized window treatment of claim 1, wherein each of the layers of carbon fiber material are filament wound.

14. The motorized window treatment of claim 1, wherein the first tube further comprises a plurality of splines that extend radially from the inner surface into the void, and wherein the plurality of splines are oriented along the longitudinal axis of the first tube.

15. A roller tube for a motorized window treatment, the roller tube comprising:

a first tube comprising aluminum or steel, the first tube having an outer surface and an inner surface, and defining a single cylindrical void delimited by the inner surface, wherein a plurality of splines extend radially from the inner surface into the void, the splines being oriented along a longitudinal axis defined by the first tube; and a second tube, concentric to the first tube, the second tube comprising carbon fiber additively constructed on an outer surface of the first tube, wherein the second tube comprises a plurality of layers of carbon fiber material including an innermost layer, an outermost layer, and at least two adjacent intermediate layers, wherein the innermost layer is bonded to the first tube, a first intermediate layer of the at least two adjacent intermediate layers is bonded to the innermost layer, a second intermediate layer of the at least two adjacent intermediate layers is bonded to the first intermediate layer, and the outermost layer surrounds the innermost and first and second adjacent intermediate layers, wherein the innermost layer and the outermost layer are each oriented such that fibers of the respective layers have the same alignment relative to the longitudinal axis of the first tube, and wherein fibers of the first and second adjacent intermediate layers have a same alignment, and wherein the alignment of the first and second adjacent intermediate layers is different from the alignment of the innermost layer and the outermost layer.

16. The roller tube of claim 15, wherein at least one of the innermost layer and the first and second adjacent intermediate layers exhibits a tensile modulus of 34 million pounds per square inch (MSI) or higher.

17. The roller tube of claim 15, wherein at least one of the innermost layer and the first and second adjacent intermediate layers exhibits a tensile modulus of 42 MSI or higher.

18. The roller tube of claim 15, wherein the outermost layer exhibits a tensile modulus of 55 million MSI or higher.

19. The roller tube of claim 15, wherein the innermost layer and outermost layer are oriented such that fibers of the innermost layer and outermost layer are aligned approximately sixty to ninety degrees to the longitudinal axis of the first tube.

20. The roller tube of claim 19, wherein the first and second adjacent intermediate layers are oriented such that fibers of the first and second adjacent intermediate layers are aligned approximately five to ten degrees from the longitudinal axis of the first tube.

21. The roller tube of claim 15, wherein the second tube is bonded to the first tube via curing of the layers of carbon fiber material.

22. The roller tube of claim 15, wherein each of the layers of carbon fiber material are filament wound.

23. A method of reducing deflection of a roller tube for a motorized window treatment, the method comprising:

providing a first tube comprising aluminum or steel, the first tube defining a single cylindrical void delimited by an inner surface of the first tube;

additively constructing a second tube on an outer surface of the first tube, wherein the second tube is concentric to the first tube and comprises a plurality of layers of carbon fiber material including an innermost layer, an intermediate layer, and an outermost layer, wherein the innermost layer and the outermost layer are each oriented such that fibers of the innermost layer and the outermost layer have the same alignment relative to the longitudinal axis of the first tube; and curing the carbon fiber; and wherein the roller tube is configured to be supported only at its distal ends, has a length of at least ten feet along the longitudinal axis of the first tube, and an outer diameter that does not exceed two inches, and wherein a load from a weight of the roller tube and a weight of a covering material affixed to the outermost layer of the second tube causes the roller tube to deflect no more than one eighth of an inch from the longitudinal axis of the first tube.

24. The method of claim 23, wherein the alignment of the intermediate layer is different from the alignment of the innermost layer and the outermost layer.

25. The method of claim 23, wherein the intermediate layer comprises at least two adjacent intermediate layers that are filament wound.

26. The method of claim 25, further comprising:

selecting an alignment for the innermost layer and outermost layer such that fibers of the innermost layer and outermost layer are aligned approximately sixty to ninety degrees to a longitudinal axis of the first tube; and selecting an alignment for the at least two adjacent intermediate layers such that fibers of the at least two adjacent intermediate layers are aligned approximately five to ten degrees from the longitudinal axis of the first tube.

27. The method of claim 23, wherein the innermost layer exhibits a tensile modulus of 34 million pounds per square inch (MSI) or higher, and wherein the outermost layer exhibits a tensile modulus of 55 million MSI or higher.

* * * * *